US009249534B2

(12) United States Patent
Im et al.

(10) Patent No.: US 9,249,534 B2
(45) **Date of Patent: *Feb. 2, 2016**

(54) LAUNDRY TREATING APPARATUS AND METHOD

(71) Applicant: LG ELECTRONICS INC., Seoul (KR)

(72) Inventors: Myong Hun Im, Seoul (KR); Soo Young Oh, Seoul (KR); Moon Hee Hong, Seoul (KR); Kyung Chul Woo, Seoul (KR); Woo Young Kim, Seoul (KR); Sang Heon Lee, Seoul (KR); Byung Keol Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 14/304,541

(22) Filed: Jun. 13, 2014

(65) Prior Publication Data

US 2014/0310886 A1 Oct. 23, 2014

Related U.S. Application Data

(62) Division of application No. 12/902,396, filed on Oct. 12, 2010, now Pat. No. 8,776,297.

(30) Foreign Application Priority Data

Oct. 13, 2009 (KR) ..... 10-2009-0097351
Oct. 21, 2009 (KR) ..... 10-2009-0100287

(51) Int. Cl.
*D06F 33/02* (2006.01)
*D06F 21/00* (2006.01)
(Continued)

(52) U.S. Cl.
CPC ..... *D06F 21/00* (2013.01); *D06F 33/02* (2013.01); *D06F 37/266* (2013.01); *D06F 37/267* (2013.01); *D06F 39/088* (2013.01); *D06F 2202/085* (2013.01); *D06F 2204/06* (2013.01); *D06F 2204/086* (2013.01)

(58) Field of Classification Search
CPC ..... D06F 33/02
See application file for complete search history.

(56) References Cited

U.S. PATENT DOCUMENTS 2,432,766 A 12/1947 Kirby
2,540,717 A 2/1951 Diether
2,556,490 A 6/1951 Chamberlin
(Continued)

FOREIGN PATENT DOCUMENTS

CN 1300892 A 6/2001
CN 1070953 C 9/2001
(Continued)

OTHER PUBLICATIONS

Chinese Office Action dated Apr. 2, 2014 issued in Application No. 201080048027.8.
(Continued)

*Primary Examiner* — Jason Ko
(74) *Attorney, Agent, or Firm* — Ked & Associates, LLP

(57) ABSTRACT

A laundry treating apparatus includes a cabinet, a tub provided in the cabinet, a drum rotatably provided in the tub for receiving laundry, a gasket provided between the cabinet and the tub, a plurality of spray nozzles provided at a lower part of the gasket for spraying wash water upward into the drum, and a pump for pumping wash water to the spray nozzles.

23 Claims, 24 Drawing Sheets

(51) Int. Cl.

| | |
|---|---|
| ***D06F 37/26*** | (2006.01) |
| ***D06F 39/08*** | (2006.01) |

(56) References Cited

U.S. PATENT DOCUMENTS

| | | | | |
|---|---|---|---|---|
| 2,942,447 | A | 6/1960 | Rickel et al. | |
| 3,387,310 | A | 6/1968 | Marshall | |
| 3,388,410 | A | 6/1968 | Marshall | |
| 3,811,300 | A | 5/1974 | Barton et al. | |
| 4,489,574 | A | 12/1984 | Spendel | |
| 4,916,768 | A | 4/1990 | Broadbent | |
| 5,191,668 | A | 3/1993 | Euler et al. | |
| 5,219,370 | A | 6/1993 | Farrington et al. | |
| 5,335,524 | A | 8/1994 | Sakane | |
| 5,560,061 | A | 10/1996 | Wentzlaff et al. | |
| 5,758,377 | A | 6/1998 | Cimetta et al. | |
| 5,768,730 | A | 6/1998 | Matsumoto et al. | |
| 5,813,069 | A | 9/1998 | Kim | |
| 5,870,905 | A | 2/1999 | Imamura et al. | |
| 6,023,854 | A | 2/2000 | Tsunomoto et al. | |
| 6,029,299 | A | 2/2000 | Baek et al. | |
| 6,158,072 | A | 12/2000 | Baek et al. | |
| 6,401,284 | B1 | 6/2002 | Jeon et al. | |
| 6,460,382 | B1 | 10/2002 | Kim et al. | |
| 7,127,767 | B2 | 10/2006 | McAllister et al. | |
| 7,146,669 | B2 | 12/2006 | Orszulik | |
| 7,331,075 | B2 | 2/2008 | Lee et al. | |
| 7,478,547 | B2 | 1/2009 | Okazaki et al. | |
| 7,490,490 | B2 | 2/2009 | Hirasawa et al. | |
| 7,530,133 | B2 | 5/2009 | Mitts | |
| RE40,732 | E | 6/2009 | Jeon et al. | |
| 7,568,366 | B2 | 8/2009 | Chang et al. | 68/24 |
| 7,739,765 | B2 | 6/2010 | Ashrafzadeh et al. | |
| 2001/0054203 | A1 | 12/2001 | Bringewatt et al. | |
| 2003/0020431 | A1 | 1/2003 | Kiuchi et al. | |
| 2003/0089139 | A1 | 5/2003 | Orszulik | 65/58 |
| 2003/0208852 | A1 | 11/2003 | Hardaway et al. | |
| 2003/0208855 | A1 | 11/2003 | McAllister et al. | |
| 2004/0148710 | A1 | 8/2004 | Kim | |
| 2004/0158933 | A1 | 8/2004 | Seo et al. | |
| 2004/0194226 | A1 | 10/2004 | Kim et al. | |
| 2005/0044641 | A1 | 3/2005 | Hyeong | |
| 2005/0050646 | A1 | 3/2005 | Lee et al. | |
| 2005/0066999 | A1 | 3/2005 | Dietz et al. | |
| 2005/0120492 | A1 | 6/2005 | Koo et al. | 8/159 |
| 2005/0160536 | A1 | 7/2005 | McAllister et al. | |
| 2005/0223504 | A1 | 10/2005 | Lee et al. | |
| 2005/0268669 | A1 | 12/2005 | Ko et al. | |
| 2005/0268670 | A1 | 12/2005 | Hirasawa et al. | |
| 2006/0021392 | A1 | 2/2006 | Hosoito et al. | |
| 2006/0048548 | A1 | 3/2006 | Park et al. | 68/12.06 |
| 2006/0112496 | A1 | 6/2006 | Kim | |
| 2006/0185095 | A1 | 8/2006 | Mitts | |
| 2007/0006394 | A1 | 1/2007 | Chang et al. | |
| 2007/0017262 | A1 | 1/2007 | McAllister et al. | |
| 2007/0124871 | A1 | 6/2007 | Kwon et al. | |
| 2007/0130700 | A1 | 6/2007 | Cho et al. | |
| 2007/0283507 | A1 | 12/2007 | Wong et al. | |
| 2008/0083132 | A1 | 4/2008 | Schaub et al. | |
| 2008/0172804 | A1 | 7/2008 | Vanhazebrouck et al. | |
| 2008/0196172 | A1 | 8/2008 | Jeong | |
| 2008/0201867 | A1 | 8/2008 | Bang et al. | |
| 2008/0201868 | A1 | 8/2008 | Bang et al. | |
| 2008/0222818 | A1 | 9/2008 | Yun et al. | |
| 2008/0250824 | A1 | 10/2008 | Oh et al. | |
| 2008/0276382 | A1 | 11/2008 | Benne et al. | |
| 2008/0289118 | A1 | 11/2008 | Park et al. | |
| 2008/0297098 | A1 | 12/2008 | Hollenbeck et al. | |
| 2009/0019896 | A1 | 1/2009 | Kim et al. | |
| 2009/0100608 | A1 | 4/2009 | Lee et al. | |
| 2009/0126222 | A1 | 5/2009 | Bae et al. | |
| 2009/0183319 | A1 | 7/2009 | Chai et al. | |
| 2009/0199350 | A1 | 8/2009 | Fechler et al. | |
| 2009/0249838 | A1 | 10/2009 | Kim et al. | |
| 2009/0249840 | A1 | 10/2009 | Jo et al. | |
| 2010/0005680 | A1 | 1/2010 | Kim et al. | |
| 2010/0162586 | A1 | 7/2010 | Lee | |
| 2010/0205753 | A1 | 8/2010 | Kim et al. | |

FOREIGN PATENT DOCUMENTS

| | | | |
|---|---|---|---|
| CN | 1521305 | A | 8/2004 |
| CN | 1521311 | A | 8/2004 |
| CN | 1534128 | A | 10/2004 |
| CN | 1580374 | A | 2/2005 |
| CN | 1609331 | A | 4/2005 |
| CN | 1637197 | A | 7/2005 |
| CN | 1680648 | A | 10/2005 |
| CN | 1782191 | A | 6/2006 |
| CN | 101046046 | A | 10/2007 |
| CN | 101168894 | A | 4/2008 |
| CN | 101397745 | A | 4/2009 |
| DE | 24 16 518 | A1 | 10/1975 |
| DE | 196 19 603 | A1 | 11/1997 |
| DE | 198 32 292 | A1 | 1/2000 |
| DE | 102 34 473 | A1 | 2/2004 |
| DE | 103 26 551 | A1 | 1/2005 |
| EP | 0 247 421 | A2 | 12/1987 |
| EP | 0 399 406 | A2 | 11/1990 |
| EP | 0 465 885 | A1 | 1/1992 |
| EP | 0 542 137 | A1 | 5/1993 |
| EP | 0 618 323 | A1 | 10/1994 |
| EP | 0 629 733 | A1 | 12/1994 |
| EP | 0 704 567 | A1 | 4/1996 |
| EP | 0 742 307 | A1 | 11/1996 |
| EP | 0 781 881 | | 7/1997 |
| EP | 0 796 942 | A2 | 9/1997 |
| EP | 1 116 812 | A1 | 7/2001 |
| EP | 1 164 217 | A1 | 12/2001 |
| EP | 1 380 682 | A2 | 1/2004 |
| EP | 1 428 925 | A1 | 6/2004 |
| EP | 1 447 468 | A1 | 8/2004 |
| EP | 1 524 357 | A2 | 4/2005 |
| EP | 1 555 338 | A2 | 7/2005 |
| EP | 1 555 340 | A2 | 7/2005 |
| EP | 1 612 316 | A1 | 1/2006 |
| EP | 1 619 286 | A2 | 1/2006 |
| EP | 1 634 985 | A1 | 3/2006 |
| EP | 1 788 138 | A1 | 5/2007 |
| EP | 1 983 088 | A1 | 10/2008 |
| EP | 1 995 366 | A1 | 11/2008 |
| EP | 2 042 638 | A1 | 4/2009 |
| EP | 2 080 832 | A1 | 7/2009 |
| EP | 2 090 686 | A1 | 8/2009 |
| EP | 2 103 726 | A | 9/2009 |
| EP | 1 111 117 | | 6/2011 |
| FR | 2 103 369 | | 3/1972 |
| FR | 2 921 079 | A1 | 3/2009 |
| GB | 1 329 544 | A | 9/1973 |
| GB | 2 253 215 | A | 9/1992 |
| GB | 2 325 245 | A | 11/1998 |
| JP | S58-130089 | A | 8/1983 |
| JP | 64-020897 | A | 1/1989 |
| JP | 01-288596 | A | 11/1989 |
| JP | H05-184769 | A | 7/1993 |
| JP | 05-212189 | A | 8/1993 |
| JP | 08-266776 | A | 10/1996 |
| JP | 09-239189 | A | 9/1997 |
| JP | 09-276582 | A | 10/1997 |
| JP | 10-216390 | A | 8/1998 |
| JP | H10-201991 | A | 8/1998 |
| JP | H10-328468 | A | 12/1998 |
| JP | 2000-254385 | A | 9/2000 |
| JP | 2001-009188 | A | 1/2001 |
| JP | 2001-046779 | A | 2/2001 |
| JP | 2001-095935 | A | 4/2001 |
| JP | 2001-224886 | A | 8/2001 |
| JP | 2001-232091 | A | 8/2001 |
| JP | 2002-119796 | A | 4/2002 |
| JP | 2002-153696 | A | 5/2002 |
| JP | 2002-282587 | A | 10/2002 |
| JP | 2004-057821 | A | 2/2004 |
| JP | 2004-081652 | A | 3/2004 |
| JP | 2005-131117 | A | 5/2005 |

(56) References Cited

FOREIGN PATENT DOCUMENTS

| | | | |
|---|---|---|---|
| JP | 2005-152309 | A | 6/2005 |
| JP | 2005-296631 | A | 10/2005 |
| JP | 2006-068193 | A | 3/2006 |
| JP | 2006-239142 | A | 9/2006 |
| JP | 2006-247367 | A | 9/2006 |
| JP | 2007-054416 | A | 3/2007 |
| JP | 2007-068804 | A | 3/2007 |
| JP | 2007-117140 | A | 5/2007 |
| JP | 2007-117377 | A | 5/2007 |
| JP | 2007-175528 | A | 7/2007 |
| JP | 2008-049270 | A | 3/2008 |
| JP | 2008-054826 | A | 3/2008 |
| JP | 2008-073128 | A | 4/2008 |
| JP | 4100576 | B1 | 6/2008 |
| JP | 2008-194255 | A | 8/2008 |
| JP | 2008-194256 | A | 8/2008 |
| JP | 2008-194257 | A | 8/2008 |
| JP | 2008-194258 | A | 8/2008 |
| JP | 2008-220620 | A | 9/2008 |
| JP | 2009-077747 | A | 4/2009 |
| JP | 2009-160327 | A | 7/2009 |
| JP | 2009-213800 | A | 9/2009 |
| KR | 10-1996-0034548 | A | 10/1996 |
| KR | 10-1998-0060338 | A | 10/1998 |
| KR | 10-1999-0015909 | A | 3/1999 |
| KR | 10-0219267 | B1 | 6/1999 |
| KR | 10-0205411 | B1 | 8/1999 |
| KR | 20-0154059 | Y1 | 8/1999 |
| KR | 10-0220275 | B1 | 9/1999 |
| KR | 10-0245429 | B1 | 2/2000 |
| KR | 10-2001-0004704 | A | 1/2001 |
| KR | 10-2001-00112681 | A1 | 12/2001 |
| KR | 10-2002-0010339 | A | 2/2002 |
| KR | 10-2003-0004707 | A | 1/2003 |
| KR | 10-2003-0049822 | A | 6/2003 |
| KR | 10-2004-0058999 | A | 7/2004 |
| KR | 10-2004-0073782 | A | 8/2004 |
| KR | 10-2004-0110973 | A | 12/2004 |
| KR | 10-2005-0000593 | A | 1/2005 |
| KR | 10-2005-0015687 | A | 2/2005 |
| KR | 10-2005-0017490 | A | 2/2005 |
| KR | 10-2005-0022209 | A | 3/2005 |
| KR | 10-2005-0039624 | A | 4/2005 |
| KR | 10-2005-0061701 | A | 6/2005 |
| KR | 10-0504501 | B1 | 8/2005 |
| KR | 10-0511290 | B1 | 8/2005 |
| KR | 10-2005-0093260 | A | 9/2005 |
| KR | 10-2005-0097755 | A | 10/2005 |
| KR | 10-0531333 | B1 | 11/2005 |
| KR | 10-2005-0115764 | A | 12/2005 |
| KR | 10-2005-0121052 | A | 12/2005 |
| KR | 10-2006-0001154 | A | 1/2006 |
| KR | 10-2006-0008111 | A | 1/2006 |
| KR | 10-2006-0023067 | A | 3/2006 |
| KR | 10-2006-0042636 | A | 5/2006 |
| KR | 10-2006-0064119 | A | 6/2006 |
| KR | 10-0630225 | B1 | 10/2006 |
| KR | 10-2006-0117528 | A | 11/2006 |
| KR | 10-2006-0120934 | A | 11/2006 |
| KR | 10-0651977 | B1 | 11/2006 |
| KR | 10-2006-0124219 | A | 12/2006 |
| KR | 10-0653767 | B1 | 12/2006 |
| KR | 10-2007-0001607 | A | 1/2007 |
| KR | 10-2007-0001611 | A | 1/2007 |
| KR | 10-2007-0018613 | A | 2/2007 |
| KR | 10-2007-0034901 | A | 3/2007 |
| KR | 10-2007-0038729 | A | 4/2007 |
| KR | 10-2007-0040617 | A | 4/2007 |
| KR | 10-0719845 | B1 | 5/2007 |
| KR | 10-2007-0063658 | A | 6/2007 |
| KR | 10-2007-0073136 | A | 7/2007 |
| KR | 10-0739612 | B1 | 7/2007 |
| KR | 10-0740065 | B1 | 7/2007 |
| KR | 10-2007-0089536 | A | 8/2007 |
| KR | 10-0751780 | B1 | 8/2007 |
| KR | 10-2007-0101732 | A | 10/2007 |
| KR | 10-2007-0120326 | A | 12/2007 |
| KR | 10-2008-0010589 | A | 1/2008 |
| KR | 10-2008-0010593 | A | 1/2008 |
| KR | 10-2008-0015300 | A | 2/2008 |
| KR | 10-2008-0041143 | A | 5/2008 |
| KR | 10-2008-0045996 | A | 5/2008 |
| KR | 10-2008-0057711 | A | 6/2008 |
| KR | 10-2008-0057723 | A | 6/2008 |
| KR | 10-2008-0069857 | A | 7/2008 |
| KR | 10-2008-0070275 | A | 7/2008 |
| KR | 10-2008-0079458 | A | 9/2008 |
| KR | 10-0857797 | B1 | 9/2008 |
| KR | 10-2008-0087597 | A | 10/2008 |
| KR | 10-2008-0094290 | A | 10/2008 |
| KR | 10-2008-0107097 | A | 12/2008 |
| KR | 10-2009-0013354 | A | 2/2009 |
| KR | 10-2009-0037860 | A | 4/2009 |
| KR | 10-2009-0080608 | A | 7/2009 |
| KR | 10-2009-0080821 | A | 7/2009 |
| KR | 10-2009-0085749 | A | 8/2009 |
| KR | 10-2010-0014052 | A | 2/2010 |
| KR | 10-2010-0028920 | A | 3/2010 |
| KR | 10-2010-0091721 | A | 8/2010 |
| KR | 10-0984583 | B1 | 9/2010 |
| KR | 10-2011-0016314 | A | 2/2011 |
| KR | 10-2011-0016330 | A | 2/2011 |
| KR | 10-1012594 | B1 | 2/2011 |
| RU | 2 089 691 | C1 | 9/1997 |
| RU | 2 096 546 | C1 | 11/1997 |
| RU | 2 123 550 | C1 | 12/1998 |
| RU | 2006145871 | A | 2/2006 |
| RU | 2005122725 | A | 1/2007 |
| RU | 2 293 806 | C2 | 2/2007 |
| RU | 2 339 751 | C2 | 11/2008 |
| RU | 2 398 059 | C1 | 8/2010 |
| SU | 242774 | | 4/1969 |
| SU | 1043207 | A | 9/1983 |
| SU | 1694744 | A1 | 11/1991 |
| TW | 200840905 | A | 10/2008 |
| TW | 200840906 | A | 10/2008 |
| WO | WO 98/29594 | A2 | 7/1998 |
| WO | WO 2006/009380 | A2 | 1/2006 |
| WO | WO 2008/030066 | A2 | 3/2008 |
| WO | WO 2008/069607 | A1 | 6/2008 |
| WO | WO 2008/075987 | A2 | 6/2008 |
| WO | WO 2008/099547 | A1 | 8/2008 |
| WO | WO 2008/099548 | A1 | 8/2008 |
| WO | WO 2008/099549 | A1 | 8/2008 |
| WO | WO 2008/123695 | A2 | 10/2008 |
| WO | WO 2009/017361 | A2 | 2/2009 |
| WO | WO 2009/112222 | A1 | 9/2009 |
| WO | WO 2011/053097 | A2 | 5/2011 |

OTHER PUBLICATIONS

United States Office Action dated Oct. 6, 2014 issued in U.S. Appl. No. 12/854,330.

United States Office Action dated Oct. 10, 2014 issued in U.S. Appl. No. 12/854,263.

European Search Report dated Oct. 16, 2014 issued in Application No. 10823602.7 (Full English Text).

United States Notice of Allowance dated Oct. 20, 2014 issued in U.S. Appl. No. 13/420,819.

United States Final Office Action dated Dec. 11, 2014 issued in U.S. Appl. No. 12/509,682.

United States Final Office Action dated Dec. 29, 2014 issued in U.S. Appl. No. 12/749,760.

United States Office Action dated Jan. 5, 2015 issued in U.S. Appl. No. 13/392,597.

Front Loading Automatic Washer, Use and Care Guide [online] Maytag; Aug. 18, 2006; [retrieved on Feb. 9, 2011]; Retrieved from the Internet: <URL: http://dl.owneriq.net/ 1/11ea371b-d431-44f5-8002-03a5d6ab459.pdf>; pp. 1-72.

European Search Report dated Dec. 4, 2009 issued in Application No. 09 01 0403.5.

PCT International Search Report dated May 7, 2010 issued in Application No. PCT/KR2009/005094.

(56) References Cited

OTHER PUBLICATIONS

PCT International Search Report dated Sep. 28, 2010 issued in Application No. PCT/KR2010/000884.
PCT International Search Report and Written Opinion dated Nov. 30, 2010 issued in Application No. PCT/KR2010/001992.
PCT International Search Report and Written Opinion dated Jan. 24, 2011 issued in Application No. PCT/KR2010/05266.
PCT International Search Report and Written Opinion dated Jan. 24, 2011 issued in Application No. PCT/KR2010/05258.
PCT International Search Report and Written Opinion dated Jan. 31, 2011 issued in Application No. PCT/KR2010/05257.
PCT International Search Report and Written Opinion dated Jan. 31, 2011 issued in Application No. PCT/KR2010/05260.
PCT International Search Report and Written Opinion dated Feb. 25, 2011 issued in Application No. PCT/KR2010/005255.
PCT International Search Report and Written Opinion dated Feb. 25, 2011 issued in Application No. PCT/KR2010/005807.
Chinese Office Action dated Mar. 2, 2011 issued in Application No. 200910171046.9 (with translation).
PCT International Search Report and Written Opinion dated Apr. 8, 2011 issued in Application No. PCT/KR2010/006999.
PCT International Search Report and Written Opinion dated Apr. 26, 2011 issued in Application No. PCT/KR2010/007664.
Korean Office Action issued in Application No. 10-2009-0087141 dated May 13, 2011 (full Korean text and full English translation).
Korean Office Action dated May 31, 2011 issued in Application No. 10-2008-0087871.
Korean Office Action dated May 31, 2011 issued in Application No. 10-2009-0073976.
Korean Office Action issued in Application No. 10-2009-0073978 dated Jun. 24, 2011 (full Korean text and English translation).
PCT International Search Report dated Jul. 4, 2011 issued in Application No. PCT/KR2010/006991.
International Search Report and Written Opinion issued PCT Application No. PCT/KR2010/007670 dated Aug. 16, 2011.
International Search Report and Written Opinion issued in PCT Application No. PCT/KR2011/000904 dated Sep. 21, 2011.
Korean Notice of Allowance issued in Application No. 10-2009-0087141 dated Sep. 21, 2011 (full Korean text and full English translation).
Korean Notice of Allowance issued in Application No. 10-2009-0073978 dated Sep. 27, 2011 (full Korean text and English translation).
Korean Notice of Allowance issued in KR Application No. 10-2009-0087141 dated Sep. 21, 2011 (full Korean text and full English translation).
International Search Report dated Dec. 7, 2011 issued in Application No. PCT/KR2010/007672.
International Search Report dated Dec. 22, 2011 issued in Application No. PCT/KR2010/007673.
United States Office Action dated Jul. 25, 2012 issued in U.S. Appl. No. 13/420,839.
Mexican Office Action dated Aug. 21, 2012 issued in Application No. MX/a/2011/010211 (with English Translation).
Chinese Office Action dated Sep. 5, 2012 issued in Application No. 201080005759.9 (with English Translation).
United States Office Action dated Sep. 7, 2012 issued in U.S. Appl. No. 12/509,682.
United States Office Action dated Sep. 7, 2012 issued in U.S. Appl. No. 13/420,819.
United States Office Action dated Sep. 25, 2012 issued in U.S. Appl. No. 12/749,760.
European Search Report dated Sep. 21, 2012 issued in Application No. 09 009 792.4.
United States Office Action dated Oct. 24, 2012 issued in U.S. Appl. No. 12/509,693.
Russian Office Action dated Jul. 3, 2012 issued in Application No. 2011132395 (with English translation).
Chinese Office Action dated Dec. 5, 2012 issued in Application No. 201080019657.2 (with English translation).
U.S. Final Office Action dated Dec. 13, 2012 issued in U.S. Appl. No. 12/509,682.
U.S. Final Office Action dated Nov. 14, 2012 issued in U.S. Appl. No. 13/420,839.
United States Office Action dated Feb. 1, 2013 issued in U.S. Appl. No. 13/420,819.
United States Office Action dated Feb. 4, 2013 issued U.S. Appl. No. 12/749,760.
Chinese Office Action dated Jan. 6, 2013 issued in Application No. 201080019656.8 (with English translation).
Taiwan Office Action dated Jan. 23, 2013 issued in Application No. 099126789 (with English translation).
Australian Office Action dated Jan. 29, 2013 issued in Application No. 2010287154.
U.S. Office Action dated Mar. 7, 2013 issued in U.S. Appl. No. 12/902,396.
U.S. Office Action dated Apr. 2, 2013 issued in U.S. Appl. No. 12/509,693.
Russian Office Action dated May 22, 2013 issued in Application No. 2012111656 (with English translation).
Russian Notice of Allowance dated Jun. 3, 2013 issued in Application No. 2011147906 (with English translation).
United States Final Office Action dated Jun. 14, 2013 issued in U.S. Appl. No. 12/902,396.
Russian Notice of Allowance dated Jul. 1, 2013 issued in Application No. 2011146523 (with English translation).
Russian Office Action dated Jul. 9, 2013 issued in Application No. 2011147901 (with English translation).
United States Office Action dated Jul. 17, 2013 issued in U.S. Appl. No. 12/509,693.
Chinese Office Action dated Jul. 19, 2013 issued in Application No. 201080019658.7 (with English translation).
Japanese Office Action dated Jul. 26, 2013 issued in Application No. 2012-534107.
United States Final Office Action dated Jul. 29, 2013 issued in U.S. Appl. No. 12/749,760.
Russian Decision to Grant a Patent dated Jul. 19, 2013 issued in Application No. 2012111656 (with English translation).
Taiwanese Office Action dated Aug. 8, 2013 issued in Application No. 099126789 (with English translation).
Taiwanese Office Action dated Sep. 11, 2013 issued in Application No. 099126791 (with English translation).
United States Office Action dated Sep. 24, 2013 issued in U.S. Appl. No. 12/902,396.
United States Office Action dated Sep. 27, 2013 issued in U.S. Appl. No. 12/509,682.
United States Office Action dated Oct. 2, 2013 issued in U.S. Appl. No. 12/854,372.
Russian Decision to Grant a Patent dated Oct. 9, 2013 issued in Application No. 2011146527 (with English translation).
United States Office Action dated Oct. 22, 2013 issued in U.S. Appl. No. 12/854,346.
United States Office Action dated Oct. 23, 2013 issued in U.S. Appl. No. 12/854,263.
United States Office Action dated Oct. 23, 2013 issued in U.S. Appl. No. 12/854,330.
United States Final Office Action dated Oct. 28, 2013 issued in U.S. Appl. No. 12/509,693.
U.S. Notice of Allowance issued in U.S. Appl. No. 13/420,839 dated Dec. 23, 2013.
U.S. Office Action issued in U.S. Appl. No. 12/938,110 dated Dec. 30, 2013.
U.S. Final Office Action issued in U.S. Appl. No. 12/509,682 dated Jan. 13, 2014.
U.S. Notice of Allowance issued in U.S. Appl. No. 12/854,372 dated Jan. 27, 2014.
U.S. Final Office Action issued in U.S. Appl. No. 12/854,263 dated Feb. 20, 2014.
U.S. Notice of Allowance issued in U.S. Appl. No. 12/853,346 dated Feb. 20, 2014.
Chinese Office Action dated Feb. 20, 2014 issued in Application No. 201080042220.0 (with English translation).

(56) References Cited

OTHER PUBLICATIONS

U.S. Office Action issued in U.S. Appl. No. 12/509,693 dated Feb. 21, 2014.
U.S. Final Office Action issued in U.S. Appl. No. 12/854,330 dated Feb. 21, 2014.
U.S. Office Action issued in U.S. Appl. No. 12/938,078 dated Feb. 28, 2014.
U.S. Notice of Allowance issued in U.S. Appl. No. 12/902,396 dated Mar. 7, 2014.
Chinese Office Action dated Mar. 19, 2014 issued in Application No. 201080046534.8 (with English translation).
U.S. Office Action dated Mar. 31, 2014 issued in U.S. Appl. No. 12/938,135.
U.S. Office Action dated Apr. 11, 2014 issued in U.S. Appl. No. 12/902,300.
U.S. Final Office Action dated Apr. 21, 2014 issued in U.S. Appl. No. 12/938,110.
U.S. Office Action dated May 28, 2014 issued in U.S. Appl. No. 12/749,760.
U.S. Final Office Action dated Jun. 5, 2014 issued in U.S. Appl. No. 12/509,693.
U.S. Final Office Action dated Jul. 21, 2014 issued in U.S. Appl. No. 12/902,300.
U.S. Office Action dated Jul. 31, 2014 issued in U.S. Appl. No. 12/509,682.
European Search Report dated Nov. 13, 2014 issued in Application No. 10823597.9.
European Search Report dated Jan. 21, 2015 issued in Application No. 10812324.1.
United States Office Action dated Feb. 9, 2015 issued in U.S. Appl. No. 12/938,078.
United States Final Office Action dated Feb. 10, 2015 issued in U.S. Appl. No. 12/938,034.
United States Final Office Action dated Feb. 12, 2015 issued in U.S. Appl. No. 12/509,693.
United States Final Office Action dated Feb. 26, 2015 issued in U.S. Appl. No. 12/854,330.
United States Final Office Action dated Feb. 26, 2015 issued in U.S. Appl. No. 12/938,135.
United States Office Action dated Feb. 26, 2015 issued in U.S. Appl. No. 13/145,203.
United States Final Office Action dated Mar. 16, 2015 issued in U.S. Appl. No. 12/938,110.
United States Office Action dated Aug. 22, 2014 issued in U.S. Appl. No. 12/938,110.
United States Final Office Action dated Sep. 2, 2014 issued in U.S. Appl. No. 12/938,078.
United States Final Office Action dated Sep. 9, 2014 issued in U.S. Appl. No. 12/938,135.
United States Office Action dated Sep. 19, 2014 issued in U.S. Appl. No. 12/938,034.
United States Office Action dated Sep. 24, 2014 issued in U.S. Appl. No. 12/509,693.
European Search Report dated Jun. 1, 2015 issued in Application No. 10808346.0.
European Search Report dated Jun. 1, 2015 issued in Application No. 10808348.6.
U.S. Final Office Action dated Jun. 29, 2015 issued in U.S. Appl. No. 12/854,253.
U.S. Office Action dated Jul. 27, 2015 issued in U.S. Appl. No. 12/938,034.
U.S. Office Action dated Aug. 11, 2015 issued in U.S. Appl. No. 12/938,110.
Maytag Front Loading Automatic Washer, Use and Care Guide; Aug. 18, 2006; pp. 1-72.
European Search Report issued in Application No. 10808344.5 dated May 21, 2015.
European Search Report issued in Application No. 10808345.2 dated May 22, 2015.
U.S. Office Action issued in U.S. Appl. No. 12/938,078 dated Jun. 10, 2015.
U.S. Office Action issued in U.S. Appl. No. 12/854,263 dated Jun. 29, 2015.
Notice of Allowance issued in U.S. Appl. No. 12/749,760 dated Jun. 8, 2015.
U.S. Final Office Action dated Aug. 19, 2015 issued in U.S. Appl. No. 13/145,203.
United States Final Office Action dated Jun. 29, 2015 issued in U.S. Appl. No. 12/854,263.
United States Final Office Action dated Sep. 8, 2015 issued in U.S. Appl. No. 13/392,597.
United States Final Office Action dated Sep. 21, 2015 issued in U.S. Appl. No. 12/938,135.
United States Office Action dated Nov. 10, 2015 issued in U.S. Appl. No. 12/749,760.
Thomson; WPI Database; Thomson Scientific London, Great Britain; Week 200645; Abstract of KR 10-2005-0061701 dated Jun. 23, 2005 (previously submitted) (XP-002745090).
European Search Report dated Oct. 7, 2015 issued in Application No. 10827181.8.
European Search Report dated Oct. 8, 2015 issued in Application No. 10741402.1.

LAUNDRY TREATING APPARATUS AND METHOD

CROSS-REFERENCE TO RELATED APPLICATION

The present application is a Divisional of co-pending U.S. patent application Ser. No. 12/902,396 filed Oct. 12, 2010, which claims priority which claims priority under 35 U.S.C. §119 to Korean Patent Application No. 10-2009-0097351 filed in Korea on Oct. 13, 2009 and 10-2009-0100287 filed in Korea on Oct. 21, 2009, which is hereby incorporated in its entirety.

BACKGROUND

1. Field

The present disclosure relates to a laundry treating apparatus.

2. Background

Generally, a laundry treating apparatus is an apparatus that washes or dries laundry. When the laundry is treated by the laundry treating apparatus, wash water, introduced from the outside, is circulated and sprayed. The wash water is circulated by a circulation pump, and is then sprayed. The circulation pump generally has a limited capacity. Therefore, increasing water pressure in a short time and spraying wash water are limited when the amount of laundry is large. Also, the water pressure is generally limited based on the capacity of the circulation pump. However, when the circulation pump is operated and wash water is sprayed to laundry, the wash water may not be uniformly sprayed to the laundry, if the water pressure is low. In particular, in a rinse cycle, rinsing time is affected by spraying of wash water. Also, laundry rinsing performance may be lowered when the wash water is not uniformly sprayed.

BRIEF DESCRIPTION OF THE DRAWINGS

The embodiments will be described in detail with reference to the following drawings in which like reference numerals refer to like elements wherein.

DETAILED DESCRIPTION

Figure 1:
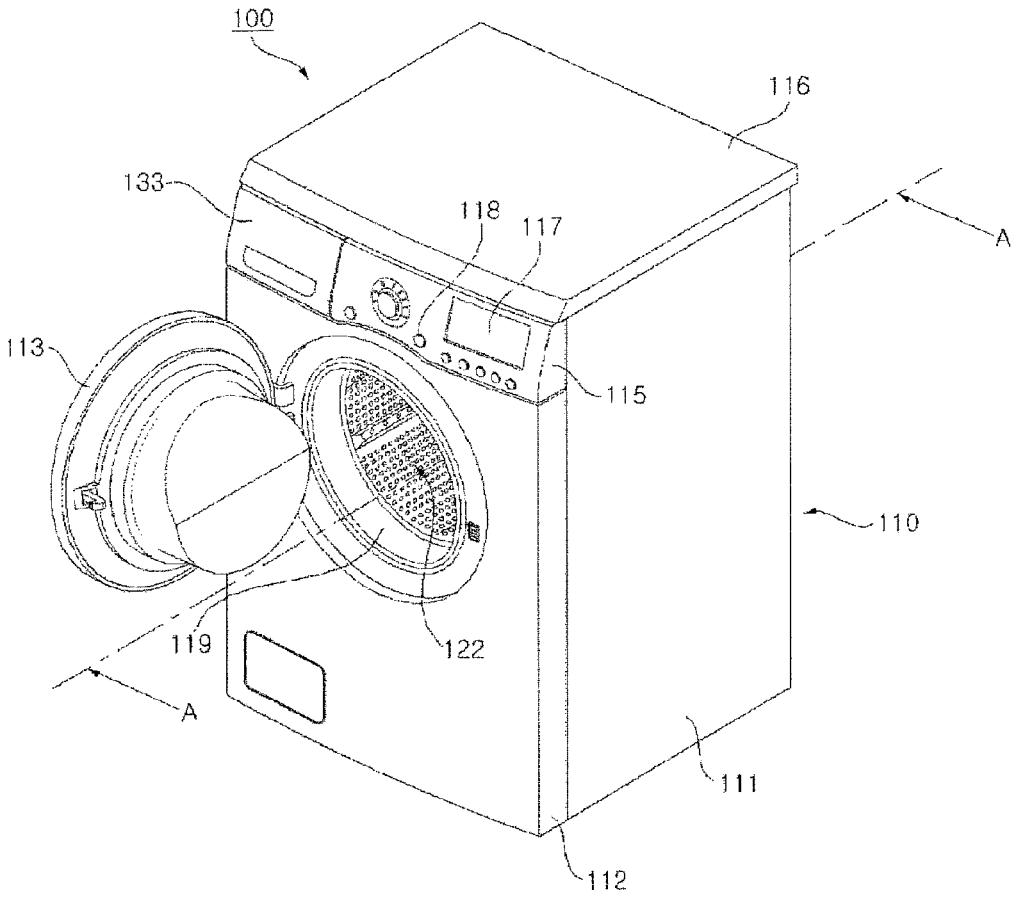
FIG. 1 is a perspective view showing a laundry treating apparatus according to an embodiment of the present disclosure.
Figure 2:
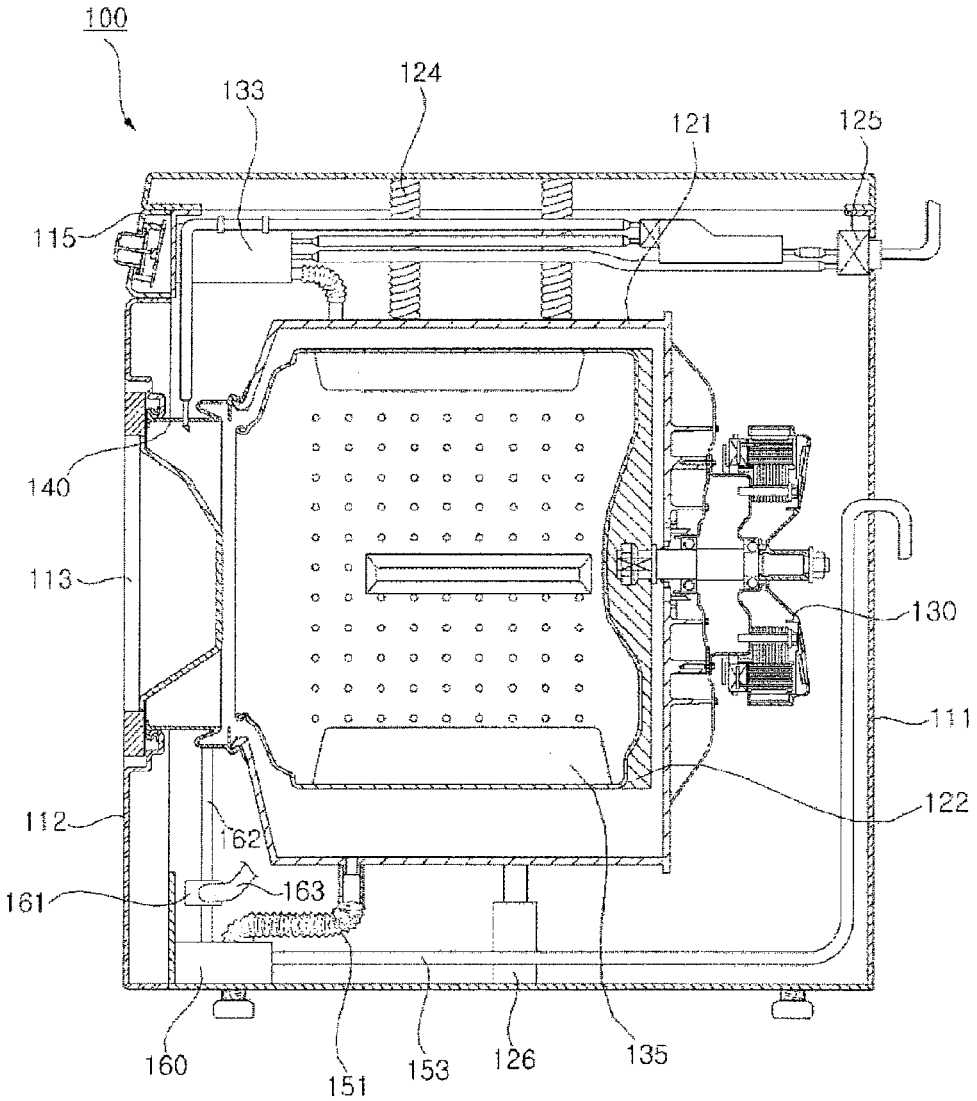
FIG. 2 is a side sectional view of the laundry treating apparatus taken along line A-A of FIG. 1.
Figure 3:
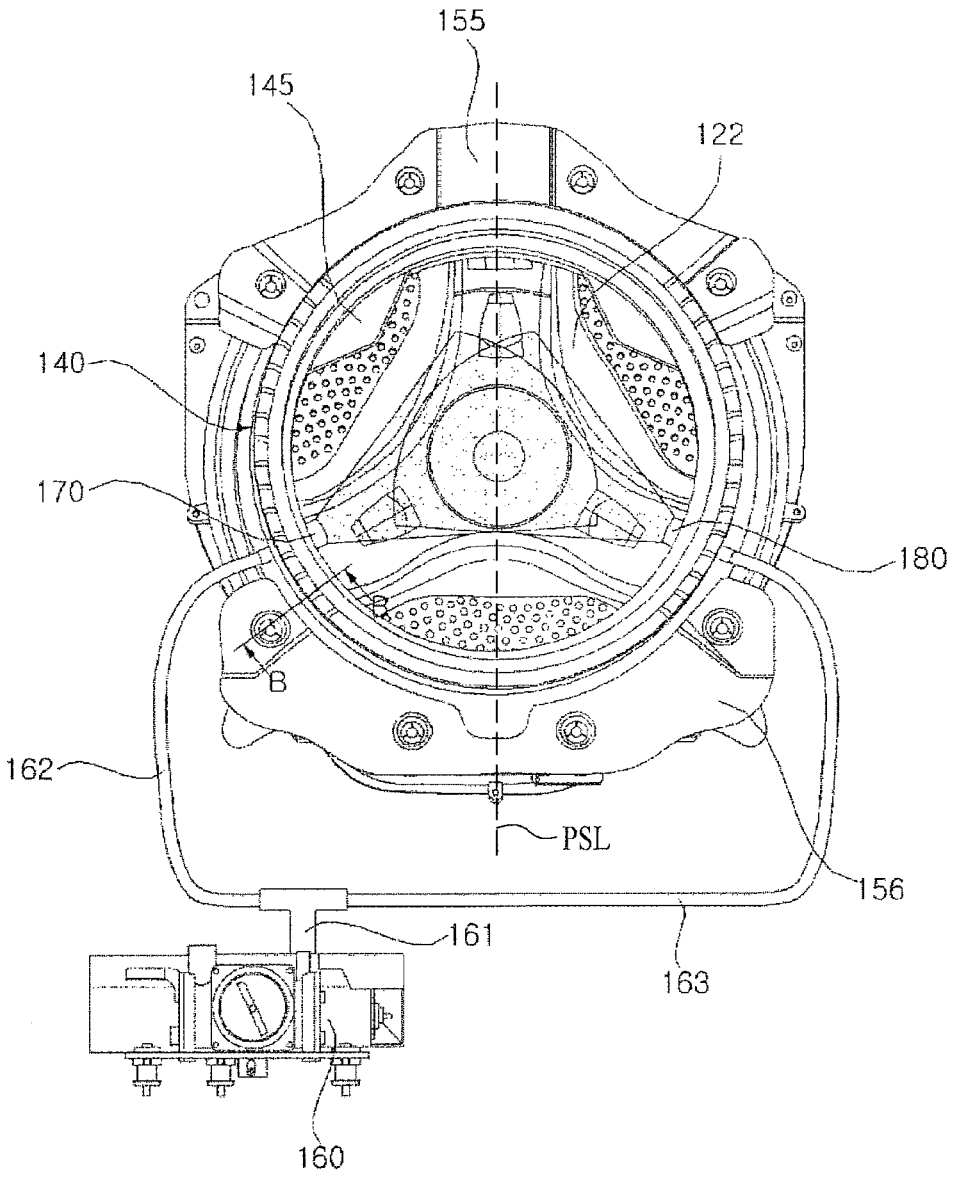
FIG. 3 is a view showing a wash water spray structure of a laundry treating apparatus according to an embodiment of the present disclosure.
Figure 4:
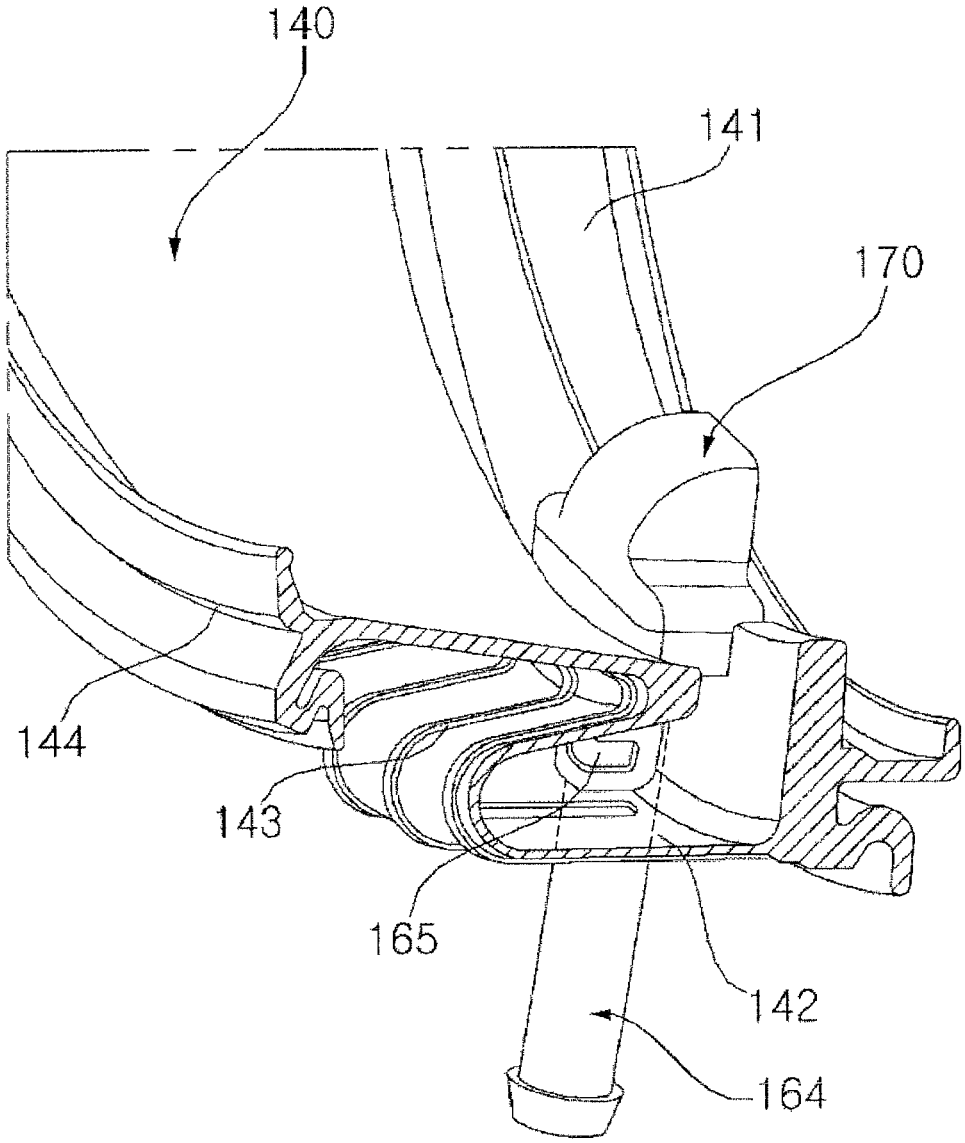
FIG. 4 is a sectional view taken along line B-B of FIG. 3.

FIG. 1 is a perspective view showing a laundry treating apparatus according to an embodiment of the present disclosure. FIG. 2 is a side sectional view of the laundry treating apparatus taken along line A-A of FIG. 1. FIG. 3 is a view showing a wash water spray structure of a laundry treating apparatus according to an embodiment of the present disclosure. FIG. 4 is a sectional view taken along line B-B of FIG. 3.

A tub 121 is disposed in a cabinet 110 for containing or retaining wash water supplied from outside, and a drum 122 is disposed in the tub 121 for receiving laundry. A drive unit 130 supplies rotational force to the drum 122, and a water supply valve 125 allows flow of wash water from an external water source. A drainage hose 151 is used for draining wash water from the tub 121. A pump 160 is used to pump water.

The cabinet 110 includes a cabinet body 111 forming an external appearance of the laundry treating apparatus 100, the cabinet body 111 being open at the front and the top thereof. A front cover 112 has a laundry entrance hole 119 for introducing laundry therethrough, and the front cover 112 being coupled to the front of the cabinet body 111. A control panel 115 is provided at the top of the front cover 112 for providing a user interface, and a top cover 116 is provided at the top of the cabinet body 111.

A door 113 is hinged at the front cover 112 for opening and closing the laundry entrance hole 119. The control panel 115 includes a display 117 for displaying various kinds of state information of the laundry treating apparatus 100 and an input unit 118 for allowing a user to input various kinds of control commands, such as washing courses, operation time for each cycle, reservation, etc.

The washing courses may include a normal course, a fragile/wool course, a high temperature course, a speedy wash course, a functional clothes course, a quiet course, etc., which differ depending upon kinds or functions of laundry. The laundry treating apparatus mainly performs a wash cycle, a rinse cycle, and a spin cycle. In each cycle, water supplying, washing, rinsing, draining, spinning, and/or squeezing is performed.

A detergent box 133 contains detergent, such as a wash detergent, a fabric softener, or a decolorant. The detergent box 133 is provided at the front of the front cover 112 such that the detergent box 133 may be easily withdrawn from the front of the front cover 112. When water is supplied, the detergent in the detergent box 133 is mixed with the water, and the mixture is introduced into the tub 121.

The tub 121 is suspended from the top cover 116 by springs 124 and is supported by a damper 126 to absorb vibration generated during the rotation of the drum 122. The drum 122 is rotated by the drive unit 130. Lifters 135 are provided inside the drum 122 for lifting laundry during the rotation of the drum 122.

A gasket 140 is provided between the cabinet 110 and the tub 121. One side of the gasket 140 is coupled to the cabinet 110, and the other side of the gasket 140 is coupled to the circumference of an open front of the tub 121. Consequently, wash water contained in the tub 121 is prevented from leaking between the tub 121 and the cabinet 110. The gasket 140 is formed so as to have pleats along the circumference thereof for absorbing vibration of the tub 121.

Referring to FIG. 4, the gasket 140 includes a tub coupling part 141 coupled to the tub 121, a cabinet coupling part 144 coupled to the cabinet 110, a pleat part 143 disposed between the tub coupling part 141 and the cabinet coupling part 144 such that the pleat part 143 is bent so as to have pleats for absorbing vibration, and a groove part 142 formed by the pleat part 143.

Connectors 164 are coupled through the groove part 142. Spray holes 165 may be formed such that some of the wash water flowing to spray nozzles 170 and 180 through the connectors 164 is sprayed to the groove part 142. Wash water sprayed through the spray holes 165 flows downward along the groove part 142 to sweep residual detergent or contaminants separated from laundry. Consequently, the gasket 140 may be provided at the lower part thereof with a drainage hole 168 (see FIG. 8) through which the wash water flowing downward along the groove part 142 is drained.

The connectors 164 are coupled to the gasket 140 such that the spray holes 165 are directed to the lower part of the gasket 140. At this time, the connectors 164 may be provided at the left and right sides of a perpendicular symmetrical line PSL of the gasket 140 such that the connectors 164 are symmetrical to each other about the perpendicular symmetrical line PSL. A first spray nozzle 170 and a second spray nozzle 180 are connected to the respective connectors 164. Consequently, wash water is sprayed toward the lower part of the gasket 140 through the connectors 164, thereby effectively cleaning the gasket 140.

Each of the spray holes 165 may be formed in the shape of a slit extending in the circumferential direction of each of the connectors 164. Since the spray holes 165 extend in the circumferential direction of the connectors 164, wash water having a sufficient width is sprayed to effectively clean the groove part 142. Also, since each of the spray holes 165 is formed in the shape of a narrow and lengthy slit, spray intensity of wash water is increased. The spray holes 165 may be located inside the groove part 142 such that wash water flows without overflowing the groove part 142.

The gasket 140 may be formed of a single material. Alternatively, the tub coupling part 141 of the gasket 140 may be formed of a solid material so as to secure coupling strength with the tub 140 and sufficient rigidity, and the cabinet coupling part 144 of the gasket 140 may be formed of an elastic material so as to alleviate vibration transmitted from the tub 121 to the cabinet 110.

The gasket 140 may be provided at the inner circumference thereof with a protrusion 145. Laundry, moving outward by the rotation of the drum 122, collides with the protrusion 145 and then moves inward, whereby the laundry is prevented from being discharged from the drum 122.

Meanwhile, the gasket 140 is provided with a first spray nozzle 170 and a second spray nozzle 180 for spraying wash water discharged from the tub 121 into the drum 122. In this embodiment, the two spray nozzles 170 and 180 are used to spray wash water. However, the present disclosure is not limited thereto. For example, two or more spray nozzles may be provided to spray wash water into the drum 122 in a plurality of directions. In a different example, the spray nozzles may spray a mixture of detergent and the wash water.

In this embodiment, the two spray nozzles 170 and 180 are provided at the gasket 140; however, the spray nozzles 170 and 180 may be provided at various positions as long as wash water is sprayed into the drum 122 by the spray nozzles 170 and 180. For example, the spray nozzles 170 and 180 may be provided in front of the drum 122 for spraying wash water into the drum 122. The spray nozzles 170 and 180 are provided in front of the drum 122 below the drum 122 for spraying wash water upward into the drum 122.

After the wash water contained in the tub 121 is pumped by the pump 160, the wash water is sprayed into the drum 122 by the first spray nozzle 170 and the second spray nozzle 180. In this way, circulation of wash water is achieved. In this embodiment, drainage and circulation of wash water are achieved by a pump 160. However, the present disclosure is not limited thereto. For example, a pump for drainage and a pump for circulation may be separately provided.

The wash water pumped by the pump 160 is distributed by a distributor 161, and is then guided to the first spray nozzle 170 and the second spray nozzle 180 along a first spray channel 162 and a second spray channel 163, respectively. The pump 160 may pump wash water such that the wash water is sprayed simultaneously by the first spray nozzle 170 and the second spray nozzle 180. Alternatively, the distributor 161 may alternately supply water to the nozzles 170 and 180 such that wash water is alternately sprayed between nozzles 170 and 180. The wash water is sprayed to laundry in opposite directions. The opposite direction may assist in effective treatment of the laundry. Further, it may be possible to treat laundry with uniform performance irrespective of the rotation direction of the drum 122.

The tub 121 is provided at the upper side and/or the lower side thereof with weights 155 and 156 for maintaining stability of the tub 121 by inertia thereof when the vibration of drum 122. The weights 155 and 156 may include an upper weight 155 provided at the upper side of the tub 121 and a lower weight 156 provided at the lower side of the tub 121.

The spray nozzles 170 and 180 may be connected to the gasket 140 by the connectors 164. A connector 164 for connecting the first spray nozzle 170 to the gasket 140 is shown in FIG. 4. The connector 164 extends through the gasket 140 to connect the first spray channel 162 and the first spray nozzle 170. The second spray nozzle 180 is connected to the gasket 140 in the same or similar structure.

In this embodiment, the first spray nozzle 170 and the second spray nozzle 180 are arranged at opposite sides or adjacent to the sides of the lower weight 156 such that the connectors 164 connected to the first spray nozzle 170 and the second spray nozzle 180 do not interfere with the lower weight 156. In an alternative structure in which no connectors 164 are provided at the gasket 140, the arrangement of the first spray nozzle 170 and the second spray nozzle 180 is not limited based on lower weights 156.

Meanwhile, in order to substantially uniformly spray wash water into the drum 122, the first spray nozzle 170 and the second spray nozzle 180 may be provided at the left and right sides of a perpendicular symmetrical line PSL passing through the center of the gasket 140 such that the first spray nozzle 170 and the second spray nozzle 180 are symmetrical to each other about the perpendicular symmetrical line PSL.

In this structure, the first spray nozzle 170 is provided at the left lower part of the gasket 140 for spraying wash water toward a right side of the drum 122 ranging approximately from the upper rear right side to the lower front right side thereof, and the second spray nozzle 180 is provided at the right lower part of the gasket 140 for spraying wash water toward a left side of the drum 122 ranging approximately from the upper rear left side to the lower front left side thereof. In an alternate embodiment, the first spray nozzle 170 and the second spray nozzle 180 may be configured to spray water toward the rear wall of the drum, e.g., into a region ranging from left upper part to the right lower part (nozzle 170) and into a region ranging from right upper part to the left lower part (nozzle 180). As can be appreciated, the direction of the water sprayed by the nozzles 170 and 180 may be varied or adjusted based on programming, washing cycle, user preferences, etc.

Each of the spray nozzles 170 and 180 is provided at the inside thereof with a plurality of indented guides. The guides may be formed in the shape of ribs or grooves. The guides form an indentation on a channel along which wash water is guided such that the wash water is sprayed in a specific form. A detailed description thereof will be given later.

Figure 5A:
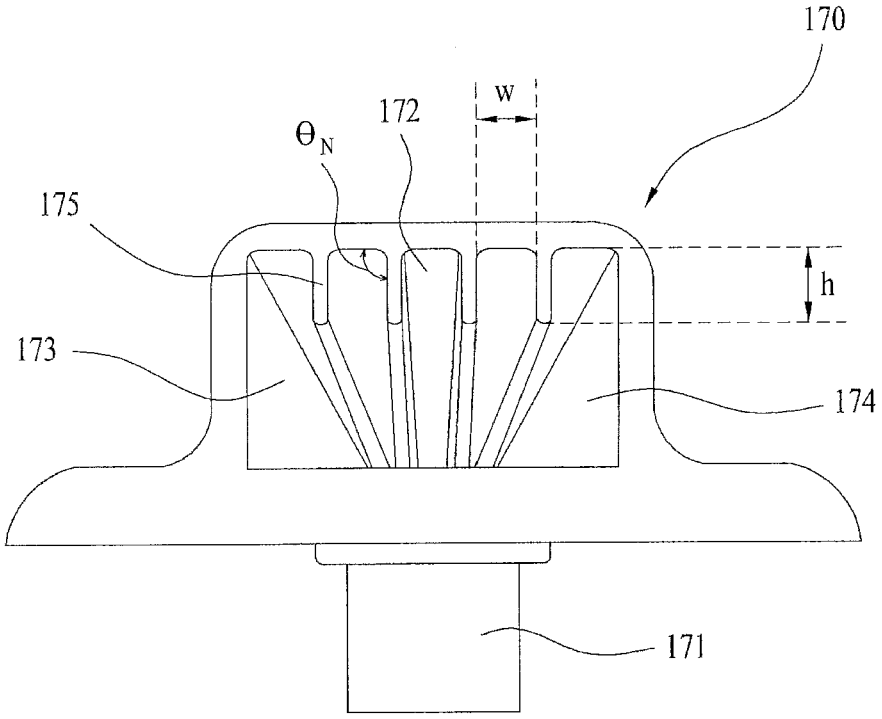
FIGS. 5A and 5B are views showing an embodiment of a spray nozzle applied to a laundry treating apparatus according to the present disclosure.
Figure 5B:
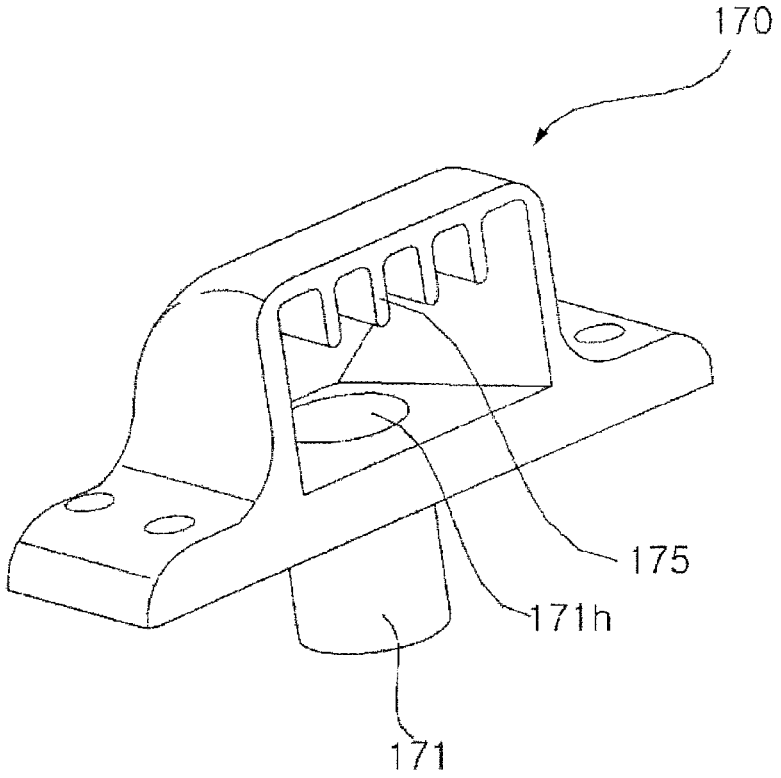
Figure 6:
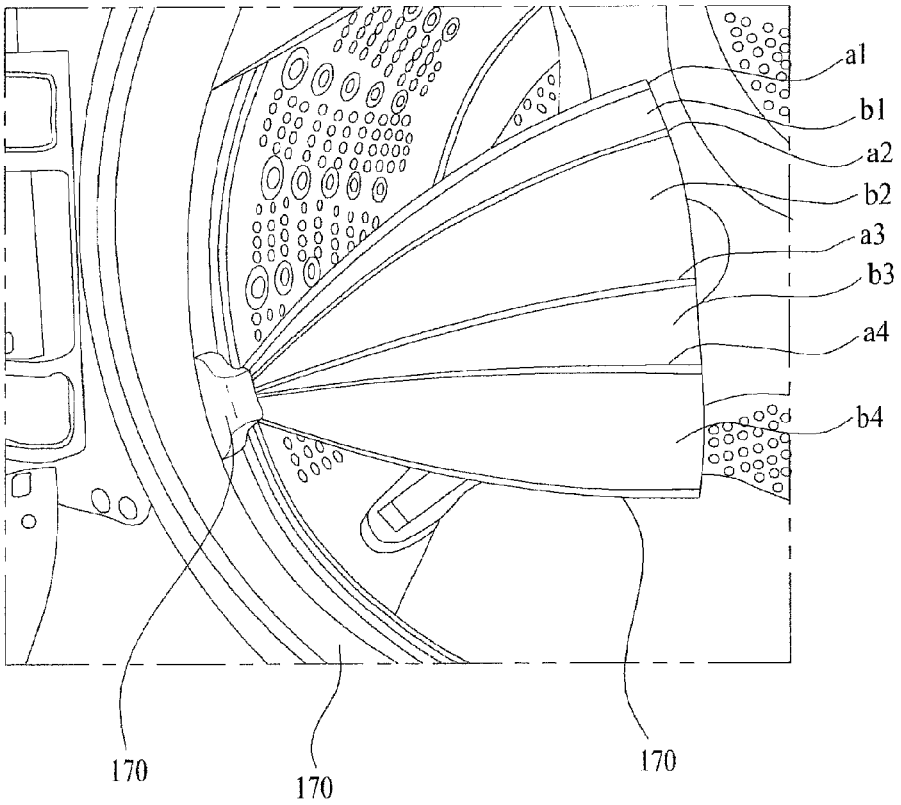
FIG. 6 is a view showing a form of wash water sprayed by a spray nozzle.

FIGS. 5A and 5B are views showing an embodiment of a spray nozzle applied to a laundry treating apparatus according to the present disclosure. FIG. 6 is a view showing a form of wash water sprayed by a spray nozzle.

A spray nozzle 170 includes an introduction part 171 for introducing wash water therethrough, a first surface 172 for directing the sprayed wash water into the drum 122, and second and third surfaces 173 and 174 extending from opposite sides of the first surface 172 for restricting the spray width of the wash water.

The wash water, pumped by the pump 160 and introduced through the introduction part 171, is guided along the first surface 172, which is formed opposite to an outlet end 171*h* of the introduction part 171 and extends into the drum 122 in an inclined shape, and is then sprayed. Since the wash water is guided along the first surface 172 by the pumping pressure of the pump 160, the wash water is sprayed in a spread state such that the sprayed wash water reaches the drum 122 in a fan shape. Although the same amount of wash water is sprayed, the wash water is sprayed over a wide region. When the first spray nozzle 170 and the second spray nozzle 180 are provided at the opposite sides of the gasket 140 as in this embodiment, wash water may be more effectively sprayed over a wider region.

Meanwhile, the first surface 172 is formed such that the width of the first surface 172 is gradually increased toward the outlet end. The second surface 173 and the third surface 174 extend from the opposite sides of the first surface 172. Consequently, the second surface 173 and the third surface 174 restrict the spray width of sprayed wash water. Also, the second surface 173 forms the lower limit of sprayed wash water, and the third surface 174 forms the upper limit of sprayed wash water. At this time, the second surface 173 and the third surface 174 are formed such that a spray region between the upper limit st2 and the lower limit st3 of the sprayed wash water intersects a rotation axis of the drum 122 as indicated by point P of FIG. 16.

Meanwhile, the first surface 172 may be provided with a plurality of ribs 175 arranged in the flow direction of wash water. The depth of wash water guided along the first surface 172 is changed by the ribs 175. As a result, water currents sprayed along channels 172 formed between the neighboring ribs 175 constitute main spray streams a1, a2, a3, a4, and a5 of a large thickness, and thin water films b1, b2, b3, and b4 are formed respectively between the main spray streams. At this time, the ribs 175 have an appropriate height such that the main spray streams a1, a2, a3, a4, and a5 are connected to one another by the water films b1, b2, b3, and b4 without separation. The height h of the ribs 175 may be equal to the distance w between neighboring ribs 175.

However, it is not necessary for the ribs 175 to extend along the first surface 172 with the same height. The ribs 175 may be formed such that the heights of the ribs 175 are gradually increased toward the outlet end of the first spray nozzle 170. In this case, the end side height h of the ribs 175 where wash water is sprayed may be equal to the distance w between neighboring ribs 175. Alternatively, the height h of each of the ribs 175 at the outlet end may vary. Generally, the distance w may be more important than h for performance, and h may be greater, less than or equal to w. As an example, the distance w and height h may be 5 mm and the angle $\theta_N$ may be 90°. $\theta_N$ may be also adjusted.

As wash water is sprayed by the spray nozzles 170 and 180 in a form including the main spray streams a1, a2, a3, a4, and a5 and the water films b1, b2, b3, and b4 formed between the respective main spray streams, the main spray streams may strongly impact to contaminants attached to laundry and, in addition, may bend and stretch the laundry, thereby improving washing performance. Also, the spray area of the wash water is still sufficiently secured by the water films.

Figure 7:
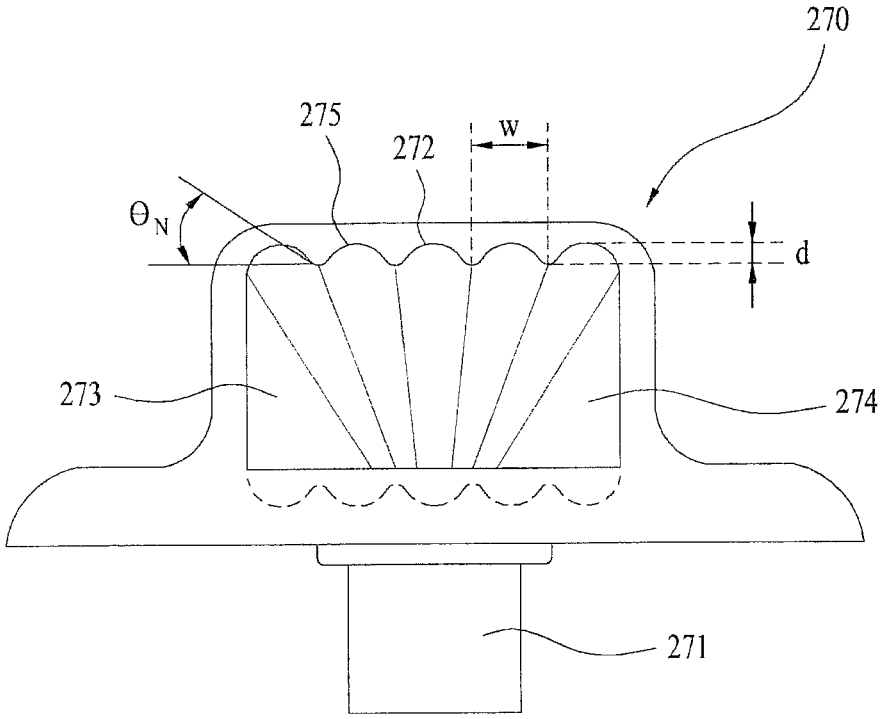
FIG. 7 is a view showing another embodiment of a spray nozzle applied to a laundry treating apparatus according to the present disclosure.

FIG. 7 is a view showing another embodiment of a spray nozzle applied to a laundry treating apparatus according to the present disclosure. In this embodiment, a spray nozzle 270 includes a plurality of grooves 275 depressed in a first surface 272 and extending in the flow direction of wash water. Each of the grooves 275 may be formed in the sectional shape of an arc. Visually, the contours look like a clam or a shell shape.

The wash water sprayed by the spray nozzle has a form in which main spray streams and water films are connected smoothly. Consequently, the spraying of wash water according to this embodiment may satisfy aesthetic sensitivity of a user. In order to achieve an appropriate spray form of wash water, each of the grooves 275 preferably has a depth d equivalent to ⅕ or less of the width w of each of the grooves 275.

However, it is not necessary for the grooves 275 to extend along the first surface 272 with the same depth. The grooves 275 may be formed such that the depths of the grooves 275 are gradually increased toward an outlet end of the first spray nozzle 270. In this case, the end side depth d of the grooves 275 where wash water is sprayed may be preferably equivalent to ¼ or less of the width w of each of the grooves 275. For example, if w is 5 mm, d may be 1.25 mm, and θN may be approximately 37°. Alternatively, the width w may gradually increase toward the outlet end. Further, the width w may be varied for each groove. For example, the width w may increase from the outer grooves to the center groove, or alternatively, the width w may decrease from the outer grooves to the center groove. Similarly, the depth may be varied.

In this embodiment, the grooves 275 are described as being formed in the first surface 272 of the spray nozzle 270. Further, grooves may be formed in the surface opposite to the first surface 272 such that wash water is sprayed between the first surface and the opposite surface thereof (see dotted line). In this case, the spray nozzle 270 may be formed approximately in a shape of a slightly open clamshell, and sprayed wash water may have a wave shape in section.

Figure 8:
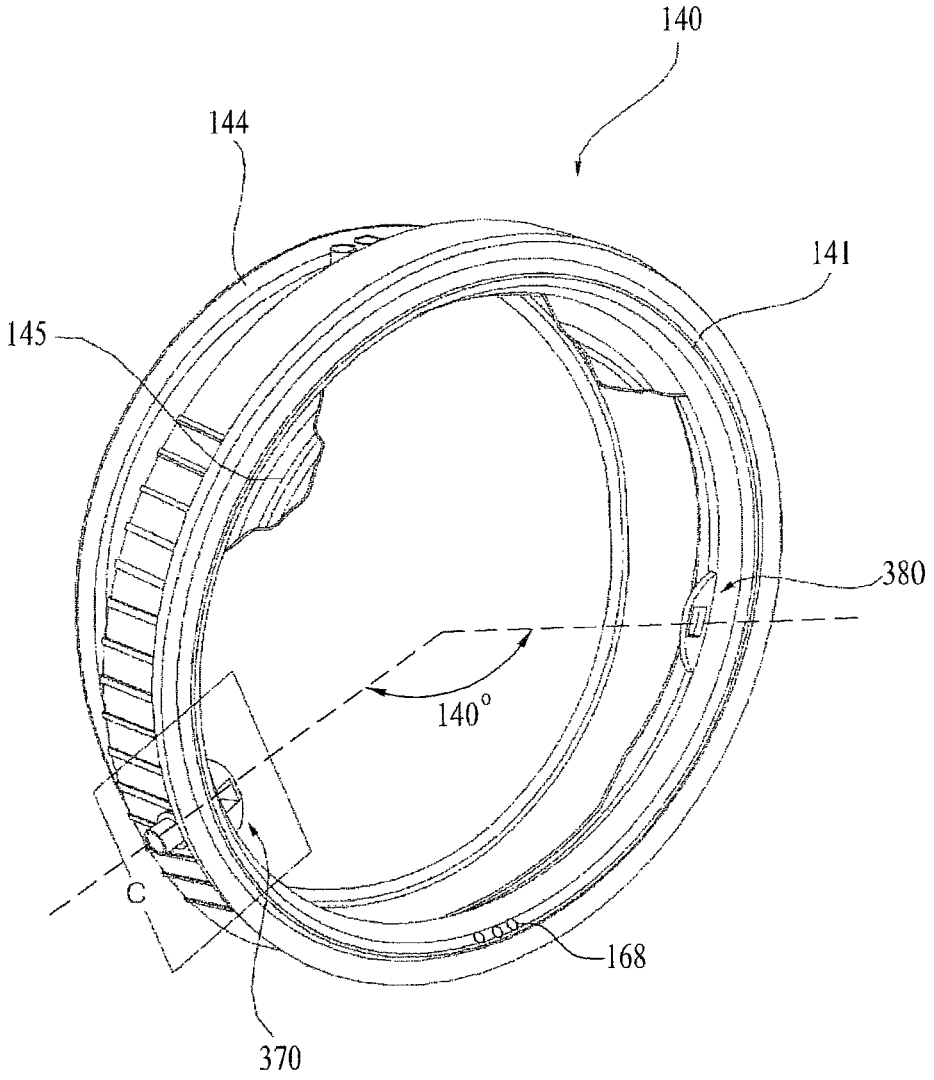
FIG. 8 is a view showing another embodiment of a spray nozzle applied to a laundry treating apparatus according to the present disclosure.
Figure 9:
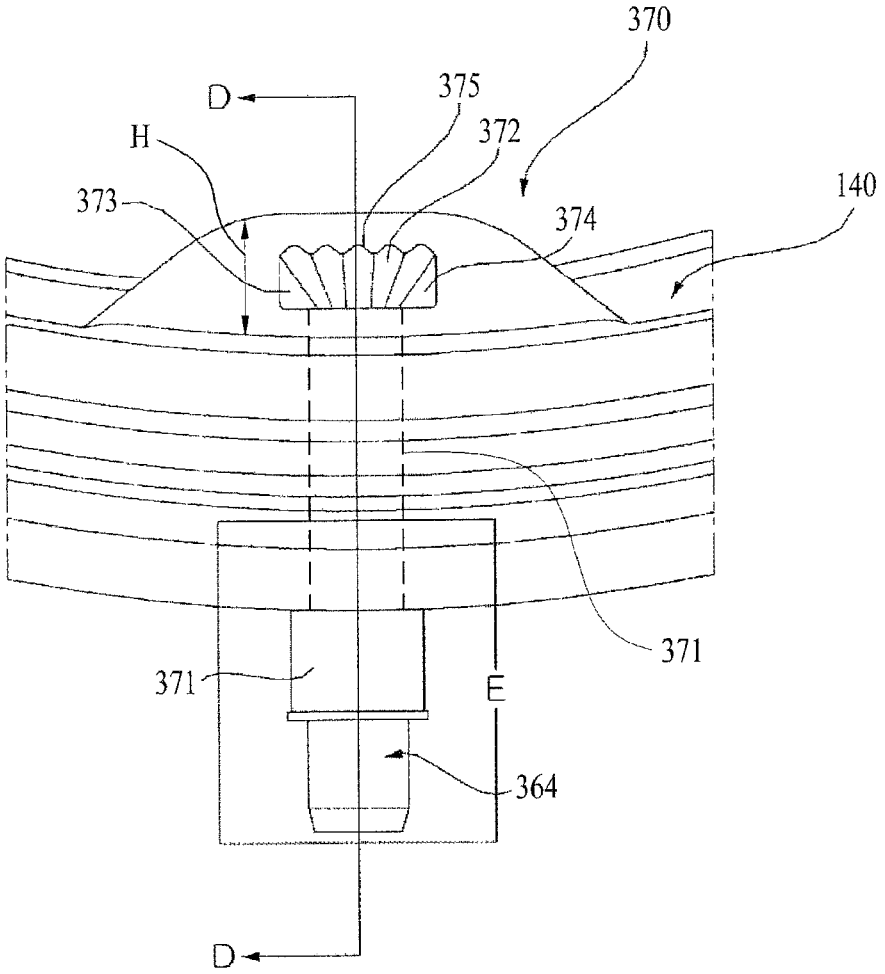
FIG. 9 is an enlarged partial view showing part C of FIG. 8.
Figure 10:
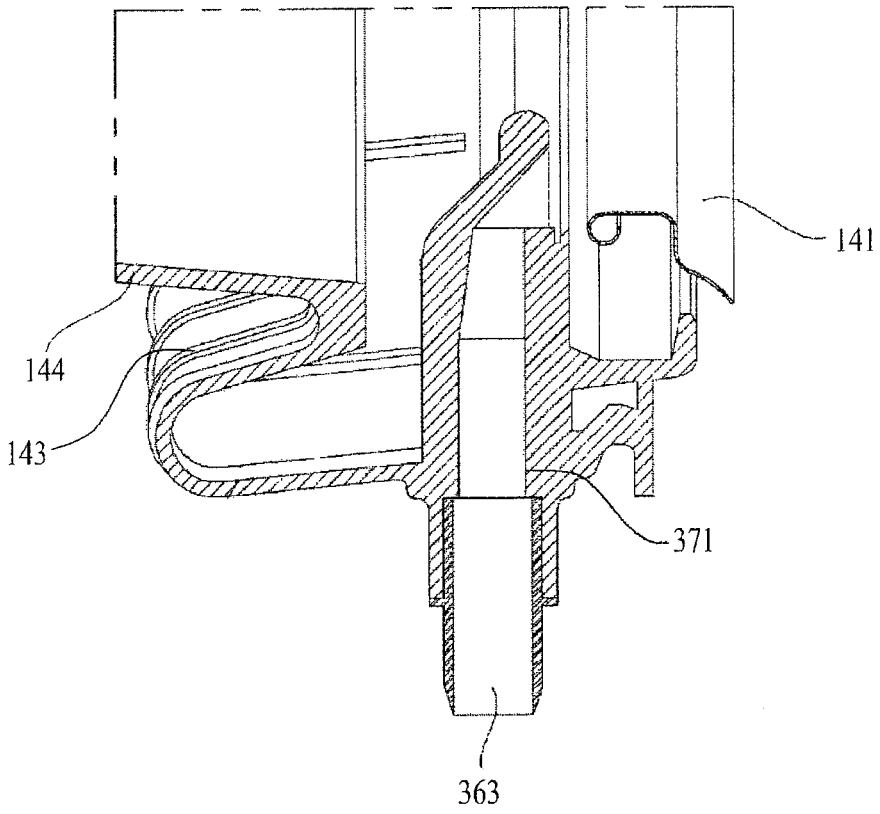
FIG. 10 is an enlarged sectional view of part E taken along line D-D of FIG. 9.

FIG. 8 is a view showing another embodiment of a spray nozzle applied to a laundry treating apparatus according to the present disclosure. FIG. 9 is an enlarged partial view showing part C of FIG. 8. FIG. 10 is an enlarged sectional view of part E taken along line D-D of FIG. 9.

Referring to FIGS. 8 to 10, this embodiment is different from the previous embodiment in that spray nozzles 370 and 380 are formed at a gasket 140 as one body. The spray nozzles 370 and 380 protrude from the gasket 140. The gasket 140 is provided with a gasket channel 371 for guiding wash water to the spray nozzles 370 and 380. The gasket channel 371 may be connected to the spray channels 162 and 163 by connectors 364.

In this embodiment, grooves 375 are formed at a first surface 372 of the spray nozzle 370. The grooves, surfaces, and angles are similar to the embodiment disclosed in FIG. 7. However, the present disclosure is not limited thereto. For example, the ribs 175 may be formed at the spray nozzle 370, similar to the embodiment disclosed in FIGS. 5A and 5B.

The first spray nozzle 370 protrudes from the inner circumference of the gasket 140. Owing to this shape of the first spray nozzle 370, laundry, moving outward by the rotation of the drum 122, collides with the first spray nozzle 370 and then moves inward, whereby the laundry is prevented from being discharged from the drum 122, and, the laundry is prevented from pouring out when the door 113 is opened after washing. In other words, the nozzles 370 and 380 provide functionality similar or same as protrusions 145. From the center of the gasket 140, the nozzles 370 and 380 may be placed 140° relative to each other. This angle may be greater or less depending on the design. Further, the height H may be 18 mm.

Figure 11:
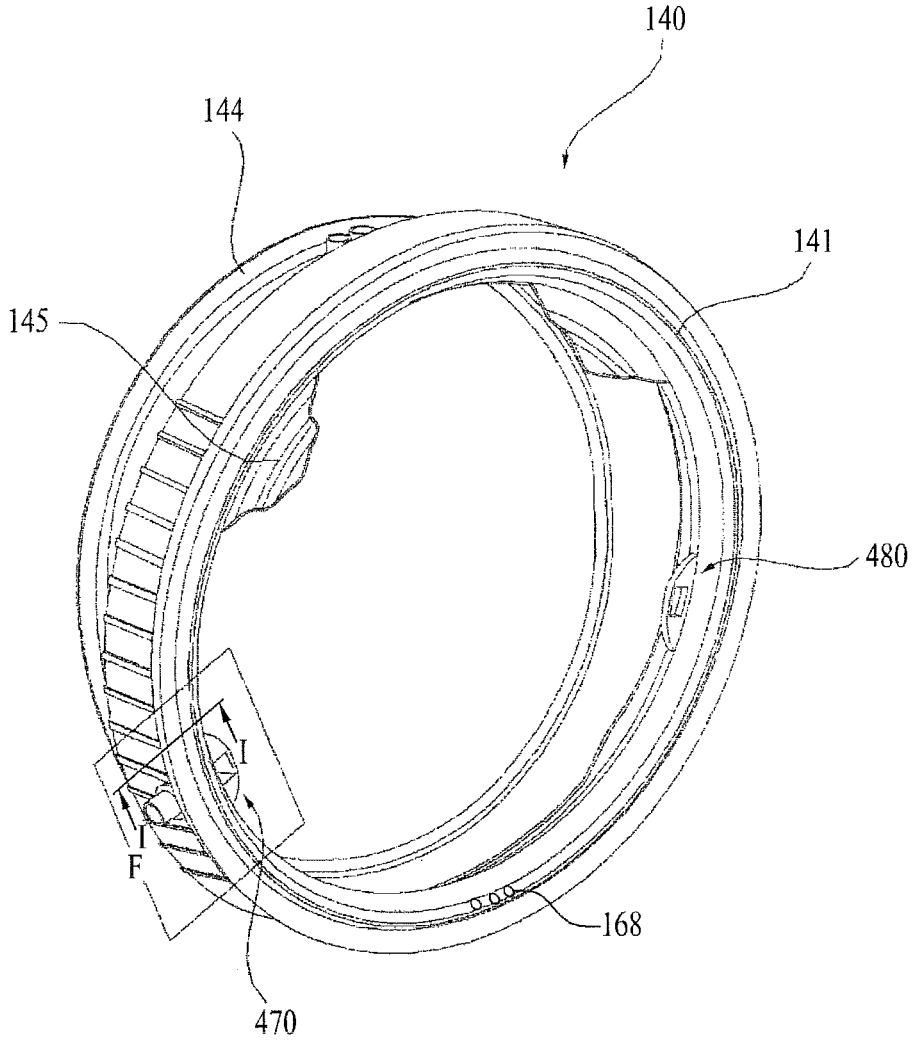
FIG. 11 is a view showing a further embodiment of a spray nozzle applied to a laundry treating apparatus according to the present disclosure.
Figure 12:
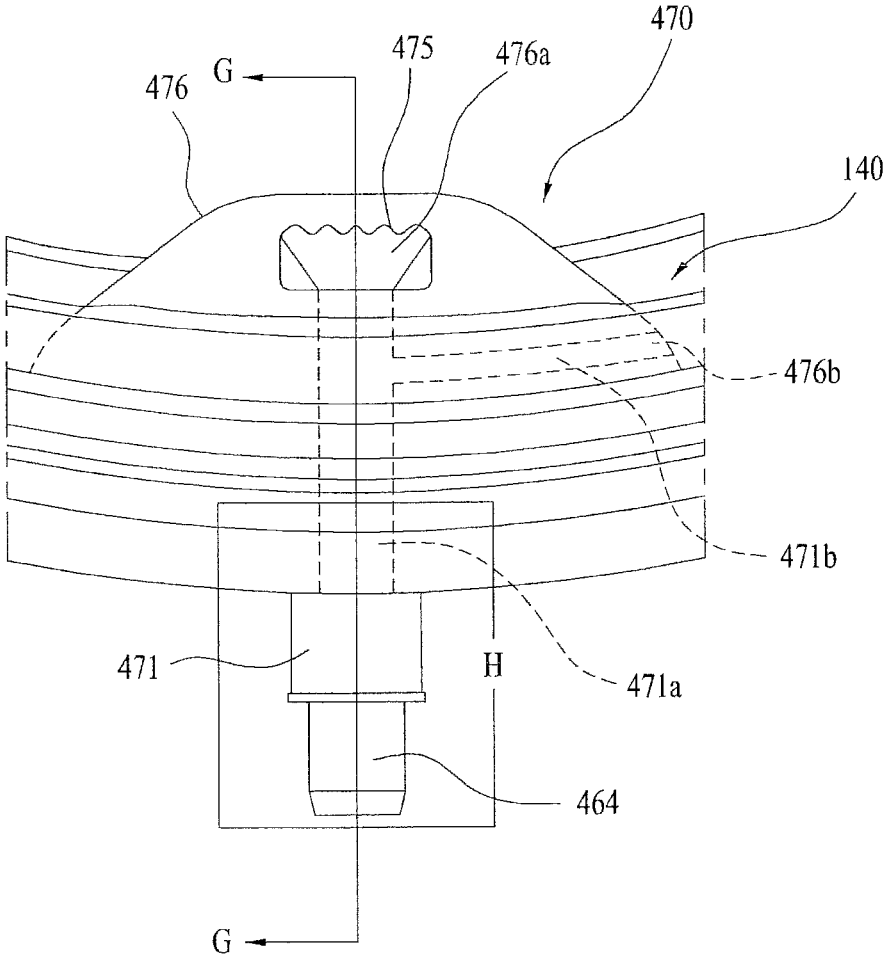
FIG. 12 is an enlarged partial view showing part F of FIG. 11.
Figure 13:
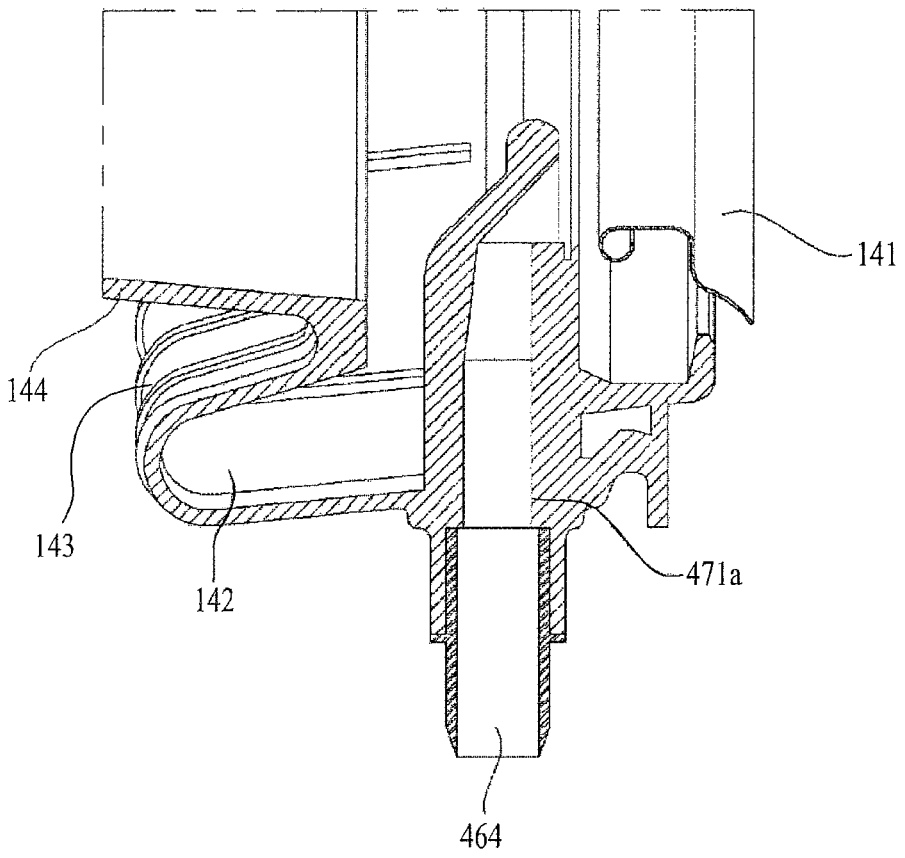
FIG. 13 is an enlarged sectional view of part H taken along line G-G of FIG. 12.
Figure 14:
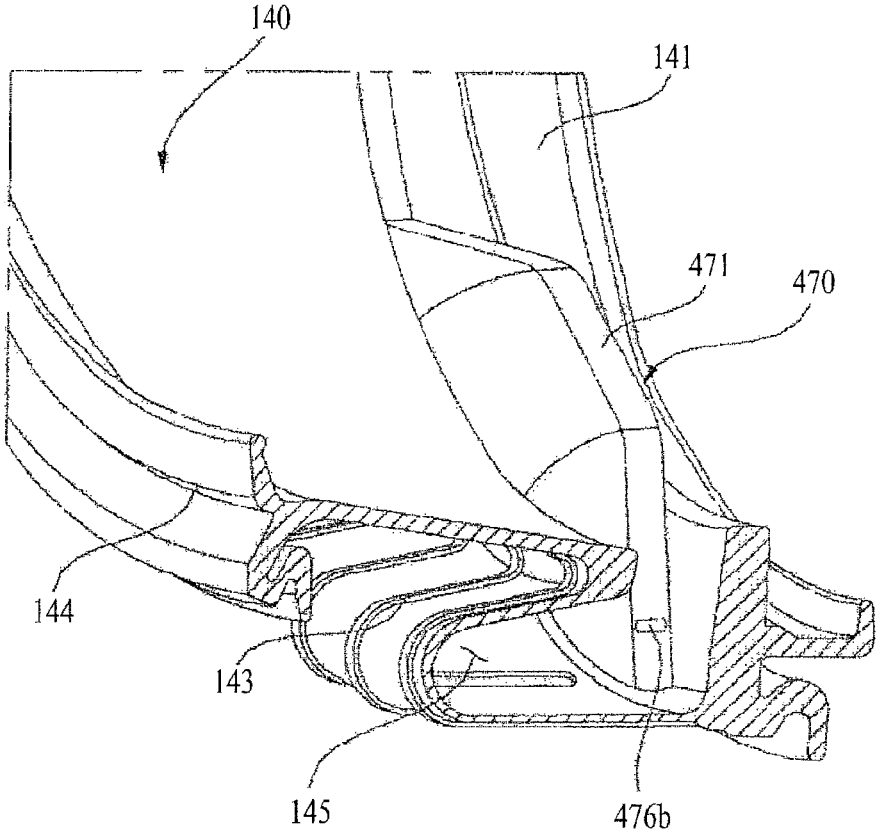
FIG. 14 is a sectional view taken along line I-I of FIG. 11.

FIG. 11 is a view showing a further embodiment of a spray nozzle applied to a laundry treating apparatus according to the present disclosure. FIG. 12 is an enlarged partial view showing part F of FIG. 11. FIG. 13 is an enlarged sectional view of part H taken along line G-G of FIG. 12. FIG. 14 is a sectional view taken along line I-I of FIG. 11. The construction of this embodiment identical or similar to that of the previous embodiments will not be described. See, e.g., FIGS. 8-10 embodiment.

Referring to FIGS. 11 to 14, spray nozzles 470 and 480 each have a first spray hole 476*a* through which some of the wash water is sprayed to the drum 122 and a second spray hole 476*b* through which some of the wash water is sprayed along a gasket 140. The spray nozzles 470 and 480 protrude from the lower part of the gasket 140 for spraying wash water upward into the drum 122. At this time, the spray nozzles 470 and 480 may be formed at a groove part 142. In this case, the first spray hole 476*a* may be formed outside the groove part 142 such that sprayed wash water does not interfere with the gasket 140. On the other hand, the second spray hole 476*b* is preferably formed inside the groove part 142 such that wash water is sprayed along the groove part 142.

Meanwhile, the gasket 140 may be provided with a first gasket channel 471*a* for guiding wash water pumped by the pump 160 and introduced through the spray channels 162 and 163 and a second gasket channel 471*b* diverging from the first gasket channel 471*a* for guiding wash water to the second spray hole 476*b*. The first gasket channel 471*a* may be connected to the spray channels 162 and 163 by connectors 464.

Even in this embodiment, the first spray nozzle 470 and the second spray nozzle 480 may be provided at the left and right sides of a perpendicular symmetrical line PSL of the gasket 140 such that the first spray nozzle 470 and the second spray nozzle 480 are symmetrical to each other about the perpendicular symmetrical line PSL, in the same or similar manner as in the previous embodiment. However, in all the embodiments, the symmetrical placement of the nozzles may be changed such that the placement is asymmetrical. Between the spray nozzles 470 and 480 may be formed a drainage hole 168 through which wash water is drained. The drainage hole may be provided at the lower part of the gasket 140.

In this embodiment, grooves 475 are formed at a first surface 475 of the spray nozzle 470. Alternatively ribs 175 may be formed at the spray nozzle 470 and the grooves 475 may be formed at the spray nozzle 480. The structure of the ribs 175 or the grooves 475 is irrespective of whether the spray nozzle is formed at the gasket as one body, and any structure may be applied to the respective embodiments.

Meanwhile, the first spray nozzle 470 protrudes from the inner circumference of the gasket 140. Owing to this shape of the first spray nozzle 470, laundry, moving outward by the rotation of the drum 122, collides with the first spray nozzle 470 and then moves inward, whereby the laundry is prevented from being discharged from the drum 122. Further, the laundry is prevented from pouring out when the door 113 is opened after washing by the nozzles 470 and 480.

Figure 15:
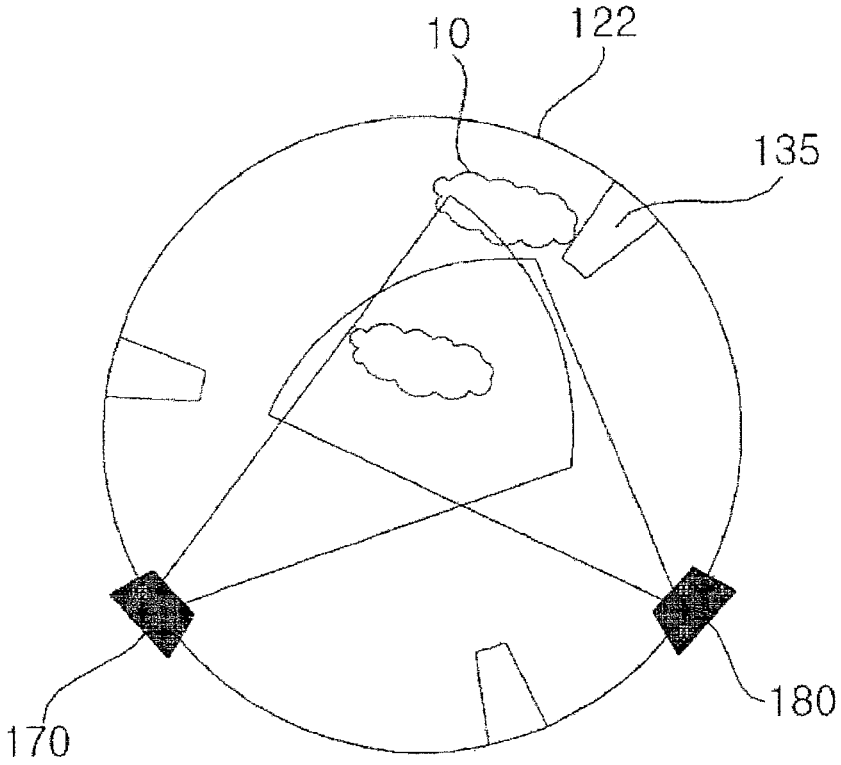
FIGS. 15 and 16 are conceptual views showing forms of wash water sprayed into a drum by a spray nozzle of a laundry treating apparatus according to an embodiment of the present disclosure.
Figure 16:
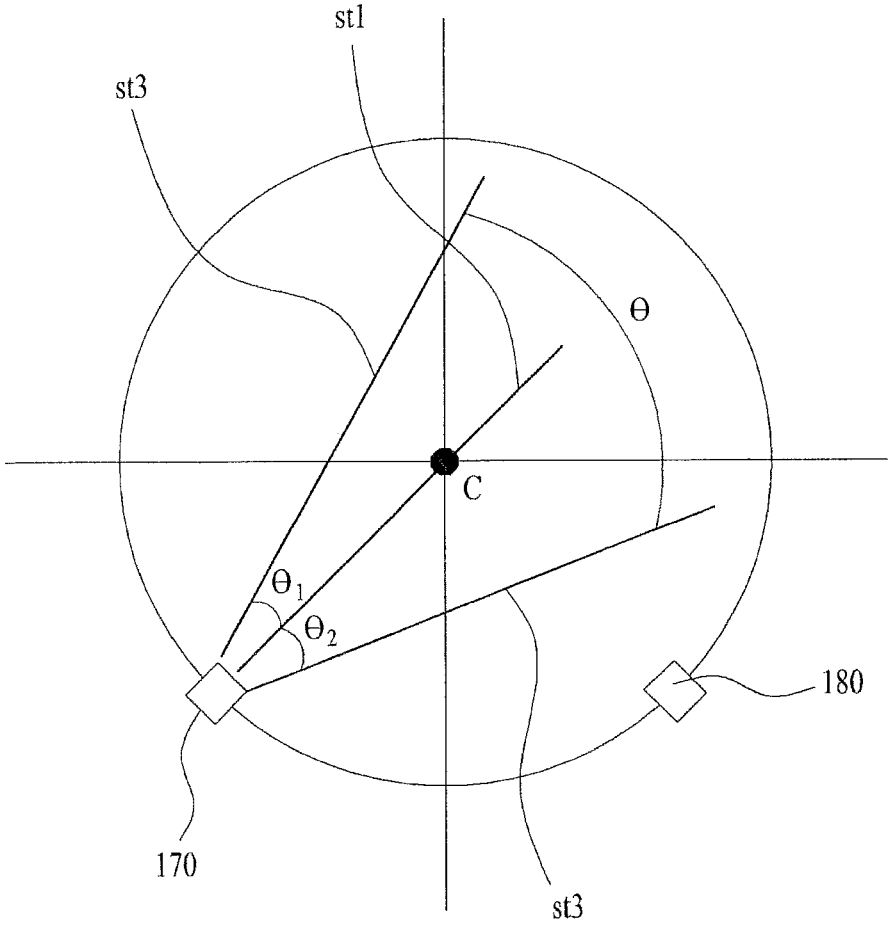
Figure 17A:
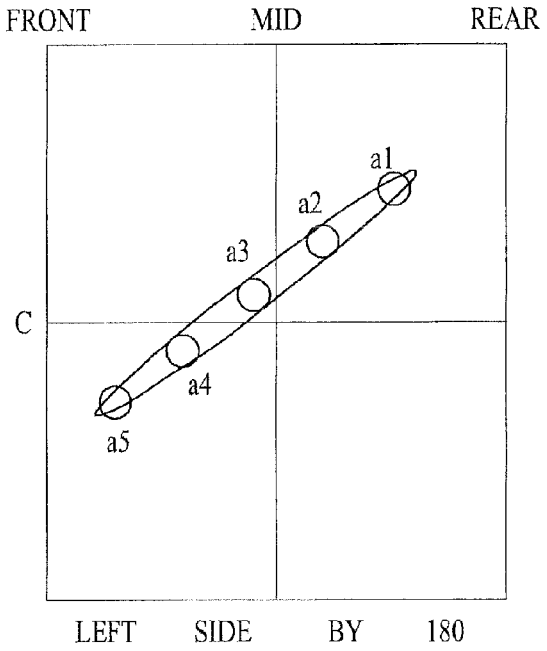
FIGS. 17A and 17B are views showing the section of wash water sprayed by a spray nozzle to explain a spray region of the wash water.
Figure 17B:
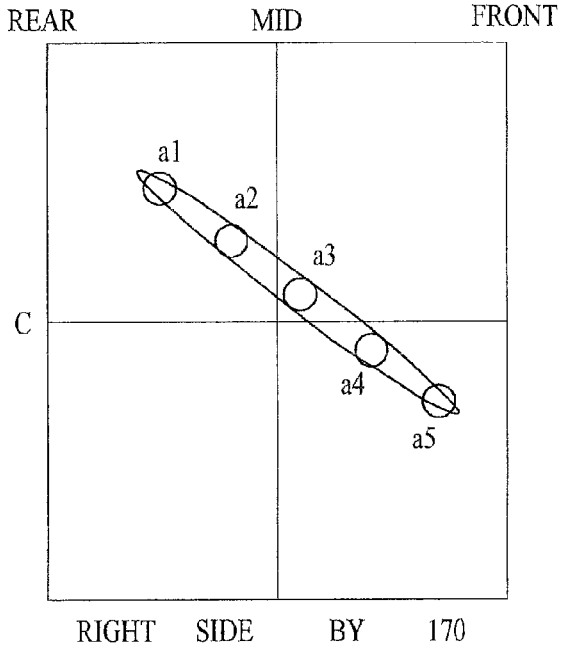

FIGS. 15 and 16 are conceptual views showing forms of wash water sprayed into a drum by a spray nozzle of a laundry treating apparatus according to an embodiment of the present disclosure. FIGS. 17A and 17B are views showing the section of wash water sprayed by a spray nozzle to explain a spray region of the wash water. In the description that follows, nozzles 170 and 180 are referenced, but as can be appreciated, the below may apply to all the embodiments.

The first spray nozzle 170 and the second spray nozzle 180 are provided at opposite sides of the lower part of the gasket 140 below half the height of the gasket 140. The first spray nozzle 170 sprays wash water upward into the drum 122 from the left lower part of the gasket 140, and the second spray nozzle 180 sprays wash water upward into the drum 122 from the right lower part of the gasket 140. Laundry 10 lifted and dropped by the lifters 135 during rotation of the drum 122 passes through the spray region defined by the first spray nozzle 170 and the second spray nozzle 180 such that the laundry 10 is treated. Because the spray nozzles spray wash water upward to falling laundry, a strong impact is imparted to the falling laundry, which may bend and stretch the laundry, and may improve laundry treating performance.

Meanwhile, the spray nozzle 170 sprays wash water such that an upper spray angle 81, which is an angle between a middle spray stream st1 joining a rotation axis C of the drum 122 and an upper limit spray stream st2 defining the upper limit of the sprayed wash water, is greater than a lower spray angle θ2, which is an angle between the middle spray stream st1 and a lower limit spray stream st3 defining the lower limit of the sprayed wash water. Wash water may be more concentratively sprayed to the upper region of the drum 122.

Owing to positional features of the first spray nozzle 170 and the second spray nozzle 180 provided at the lower part of the gasket 140, the first spray nozzle 170 sprays wash water toward a region ranging from the right upper rear side to the right lower front side of the drum 122 along a slanted line, and the second spray nozzle 180 sprays wash water toward a region ranging from the left upper rear side to the left lower front side of the drum 122 along a slanted line.

When looking into the interior of the drum 122 from the laundry entrance hole 119, wash water may be uniformly sprayed toward the right and left sides of the drum 122 by the first spray nozzle 170 and the second spray nozzle 180. The wash water sprayed by the first spray nozzle 170 forms a slanted line (ideally) ranging from a rear upper right side to a front lower right side, as shown in FIG. 17B, and the wash water sprayed by the second spray nozzle 180 forms a slanted line (ideally) ranging from a rear upper left side to a front lower left side.

The spray nozzles 170 and 180 may be formed such that at least one of the main spray streams a1, a2, a3, a4, and a5 is sprayed to the upper region of the drum 122, and at least one of the main spray streams a1, a2, a3, a4, and a5 is sprayed to the lower region of the drum 122. The upper region of the drum 122 is an interior space of the drum 122 above half the height of the drum 122 or above the center C of rotation of the drum 122, and the lower region of the drum 122 is an interior space of the drum 122 below half the height of the drum 122 or below the center C of the rotation of the drum 122.

In this embodiment, the number of the main spray streams sprayed to the upper region of the drum 122 is greater than that of the main spray streams sprayed to the lower region of the drum 122. Wash water may be more concentratively sprayed to the upper region of the drum 122.

Referring to FIGS. 17A and 17B, three, i.e., a1, a2, and a3, of the main spray streams a1, a2, a3, a4, and a5 are sprayed above the center C, and the others, i.e., a4 and a5, are sprayed below the center C.

Figure 18:
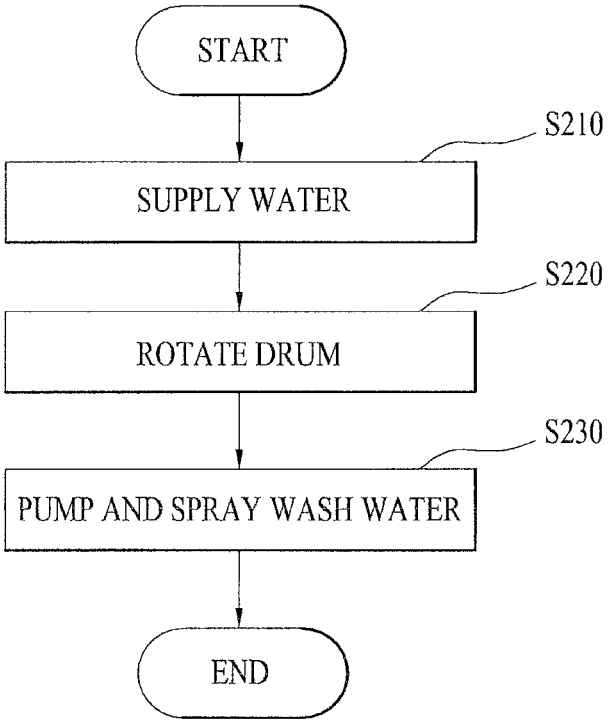
FIG. 18 is a flow chart showing a laundry treating method according to an embodiment of the present disclosure.

FIG. 18 is a flow chart showing a laundry treating method according to an embodiment of the present disclosure. Water is supplied during a wash cycle or a rinse cycle (S210). The laundry treating apparatus mainly performs a wash cycle, a rinse cycle, and a spin cycle. In each cycle, water supplying, washing, rinsing, draining, spinning, squeezing and/or drying is performed. In the wash cycle, laundry is soaked in wash water which may contain a wash detergent, and the drum 122 is rotated to remove contaminants from the laundry. In the rinse cycle, the laundry is soaked in wash water which may contain a fabric softener, and the drum 122 is rotated to remove detergent residue from the laundry.

Wash water is supplied from an external water source into the tub 121. During water supplying process, the water supply valve 125 is opened, and wash water is introduced into the tub 121 from the external water source. If detergent is needed, the wash water may be mixed with a wash detergent or a fabric softener in the detergent box 133.

The water is continuously supplied until the wash water reaches a target water level. The target water level may be set based on the amount of laundry (hereinafter, referred to as a 'load') measured before the water supplying process or a selected course. During the water supplying process, laundry soaking, in which the drum 122 is rotated, may be performed such that the laundry is uniformly or substantially soaked in the wash water containing the wash detergent.

When the water supplying process is completed, the drum 122 is rotated (S220). The drum 122, in which the laundry is placed, is rotated to perform washing or rinsing. To perform the washing or the rinsing, the drum 122 in which the laundry, soaked in the wash water containing the wash detergent or the fabric softener, is rotated. When the drum 122 is rotated by the drive unit 130, the laundry in the drum 122 is lifted and dropped by the lifters 135. Contaminants or residual detergent are removed from the laundry by friction between the laundry articles and falling of the laundry. During the washing process, the drum 122 may be rotated at various speeds or in various directions, which will be described later in detail with reference to FIG. 13.

The wash water is pumped and sprayed into the drum 122 (S230). During rotation of the drum 122, the wash water in the tub 121 is pumped by the pump 160, and is then sprayed into the drum 122 by the first spray nozzle 170 and the second spray nozzle 180. The wash water pumped by the pump 160 is distributed by the distributor 161, and is then guided to the first spray nozzle 170 and the second spray nozzle 180 along the first spray channel 162 and the second spray channel 163, respectively. At this time, the pump 160 may pump the wash water such that the wash water is sprayed simultaneously by the first spray nozzle 170 and the second spray nozzle 180.

The first spray nozzle 170 is provided at the left lower part of the gasket 140 for spraying the wash water toward a region of the drum 122 ranging approximately from the rear upper right side to the front lower right side thereof, and the second spray nozzle 180 is provided at the right lower part of the gasket 140 for spraying wash water toward a region of the drum 122 ranging approximately from the rear upper left side to the front lower left side thereof. The first spray nozzle 170 and the second spray nozzle 180 spray the wash water upward to falling laundry.

Figure 19A:
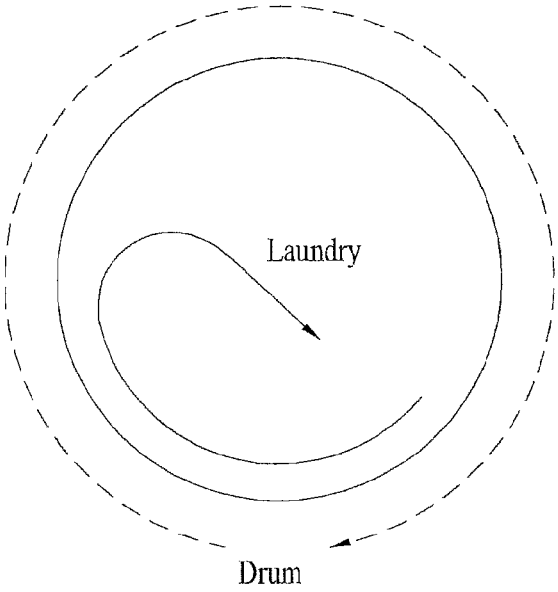
FIGS. 19A to 19E are views showing various drum motions in a laundry treating method according to an embodiment of the present disclosure.

FIG. 19A shows a motion in which the drive unit 130 rotates the drum 122 in a predetermined direction so that the laundry is lifted from the lowest position of the drum 122 and dropped in the vicinity of half the height of the drum 122 (hereinafter, referred to as a "tumbling motion"). In the tumbling motion, the drum 122 may be continuously rotated at about 45 rpm, and the laundry in the drum 122 is washed by impact and frictional force.

Figure 19B:
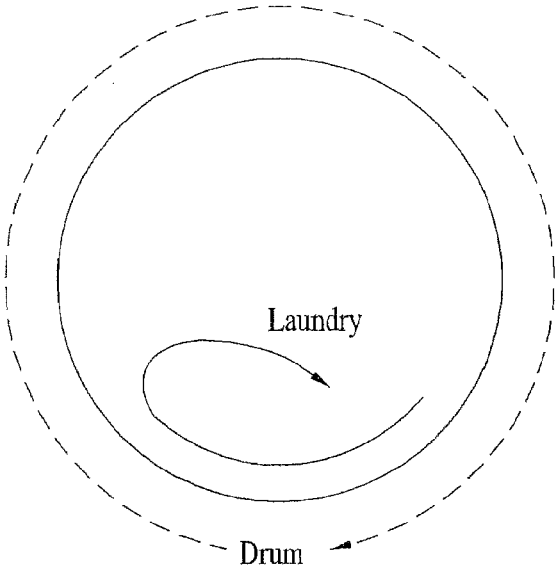

FIG. 19B shows a motion in which the drive unit 130 rotates the drum 122 in a predetermined direction so that the laundry is lifted from the lowest position of the drum 122 and dropped at a height not exceeding half the height of the drum 122 (hereinafter, referred to as a "rolling motion"). In the rolling motion, the drum 122 is continuously rotated at about 40 rpm or below, and the laundry in the drum 122 is washed by bending and stretching force and frictional force by being dropped and rolling over.

Figure 19C:
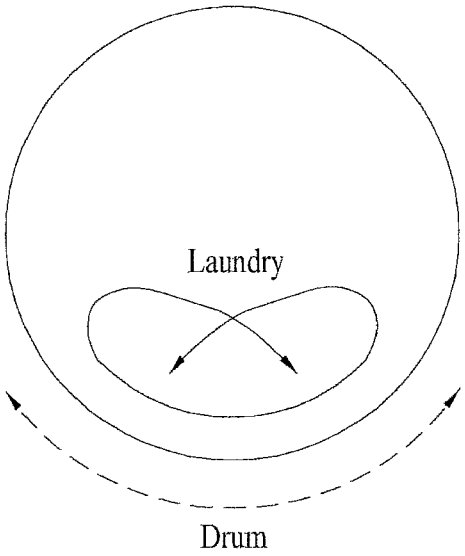

FIG. 19C shows a motion in which the drive unit 130 rotates the drum 122 in alternating directions so that the laundry is lifted from the lowest position of the drum 122 and dropped in the vicinity of half the height of the drum 122 (hereinafter, referred to as a "swing motion"). In the swing motion, the drum 122 is rotated at about 40 rpm or below in alternating directions. The laundry in the drum 122 is washed by bending and stretching force and frictional force by being dropped and rolling over.

Figure 19D:
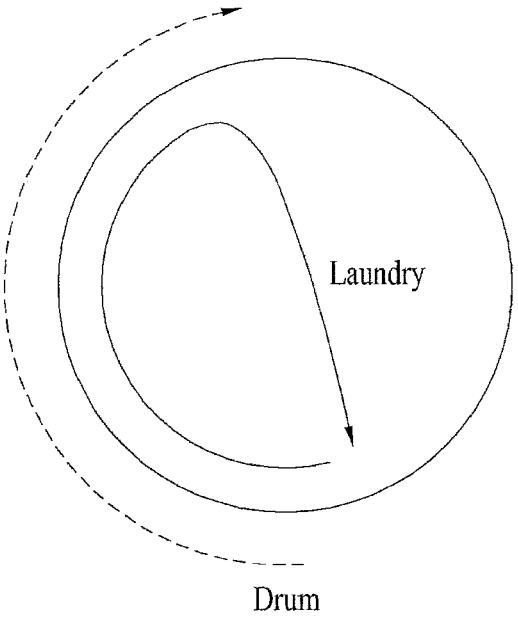

FIG. 19D shows a motion in which the drive unit 130 rotates the drum 122 in a predetermined direction so that the laundry is lifted from the lowest position of the drum 122 and dropped in the vicinity of the top of the drum 122 (hereinafter, referred to as a "step motion"). In the step motion, the drum 122 is rotated at about 60 rpm or above to raise the laundry. The laundry is raised higher than half the height of the drum 122 and then the drive unit 130 controls the drum 122 so that the laundry is dropped in the vicinity of the top of the drum 122. After the laundry is dropped, the drum 122 raises the laundry by rotating in the same direction. The laundry in the drum 122 is washed by a high impact force caused due to the falling of the laundry.

Figure 19E:
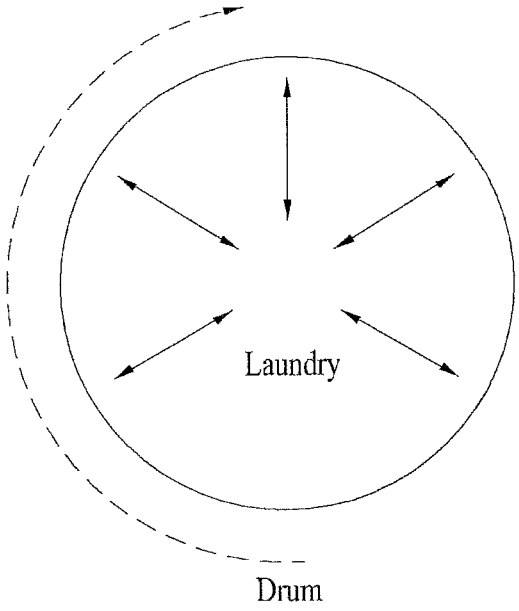

FIG. 19E shows a squeezing motion in which the drive unit 130 changes the speed of the drum 122 in short cycle so that the laundry is gathered and distributed in a repeated manner. In the squeezing motion, the speed of the drum 122 is changed in short cycle within a speed range of about 50 rpm to about 100 rpm to cause the laundry to cling to and be separated from the inside of the drum in a repeated manner. As the movement of the laundry is facilitated, washing deviation is reduced and the laundry is brought into uniform contact with the wash water.

More details of these motions are described in U.S. application Ser. No. 12/704,923 filed Feb. 12, 2010 and Ser. No. 12/854,372 filed Aug. 11, 2010 whose entire disclosures are incorporated herein by reference.

In addition, when the laundry clings to the inside of the drum, the wash water soaking through the laundry is discharged as if being squeezed out of the laundry. Therefore, contaminants are discharged from the laundry during washing as if being squeezed out, and residual detergent is discharged from the laundry as if being squeezed out. Moreover, as the laundry clings to and is separated from the inside of the drum in a repeated manner, a user may visually check the movement of the laundry.

When each of the above-described drum motions is performed, the wash water is pumped by the pump 160 and be sprayed into the drum 122 by the first spray nozzle 170 and the second spray nozzle 180. The first spray nozzle 170 and the second spray nozzle 180 spray the wash water upward to falling laundry.

Figure 20A:
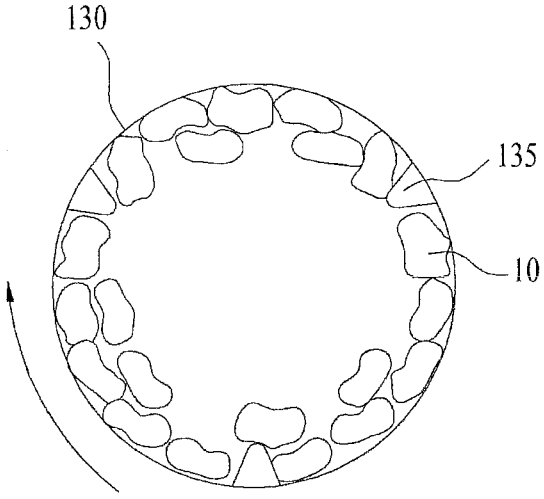
FIGS. 20A to 20C are views showing a squeezing motion in a laundry treating method according to an embodiment of the present disclosure.
Figure 20B:
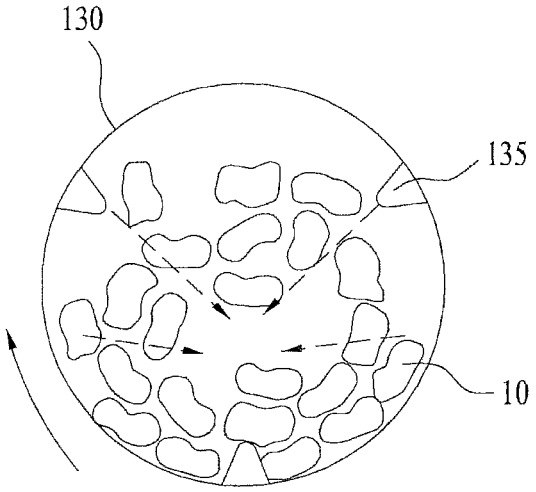
Figure 20C:
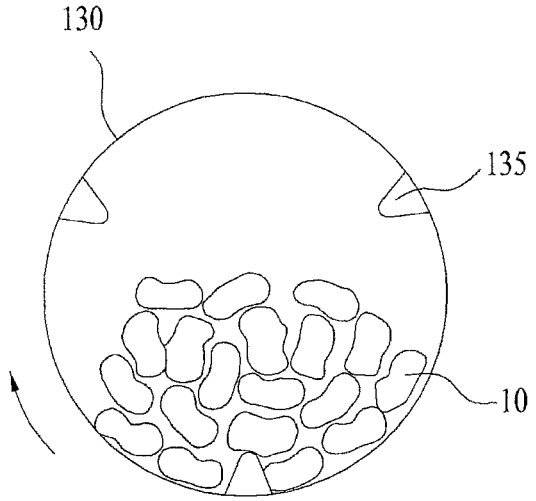

FIGS. 20A to 20C are views showing a squeezing motion in a laundry treating method according to an embodiment of the present disclosure. In a laundry treating method according to an embodiment of the present disclosure, a squeezing motion is a motion repeated in short cycle in which the drum 122 is accelerated to a high speed during a wash cycle or a rinse cycle to cause laundry 10 in the drum 122 to rotate, clinging to the inside of the drum 122, and then the drum 122 is decelerated to cause the laundry to be separated from the inside of the drum.

In FIG. 20A, when the drum 122 is rotated at a high speed, the laundry 10 in the drum 122 rotates, clinging to the inside of the drum 122. If the drum 122 is rotated at about 100 RPM, the laundry 10 rotates, clinging to the inside of the drum by centrifugal force. The drum 122 may be rotated for an appropriate amount of time at an appropriate speed so that the laundry 10 may be uniformly distributed and may cling to the inside of the drum 122.

At this time, the wash water is pumped by the pump 160 and sprayed into the drum 122 by the first spray nozzle 170 and the second spray nozzle 180. The first spray nozzle 170 and the second spray nozzle 180 spray the wash water upward to the falling laundry.

In FIG. 20B, when the drum 122 is decelerated, the laundry 10 is separated from the inside of the drum 122. When the drum 122 is decelerated to a speed at which no centrifugal force is applied to the laundry 10, the laundry 10 is separated from the drum 122 by gravity, and the drum 122 rotates, thus moving and mixing the laundry 10 uniformly. At this time, similarly to the above, the wash water is pumped by the pump 160 and sprayed into the drum 122 by the first spray nozzle 170 and the second spray nozzle 180.

In FIG. 20C, when the drum 122 is fully decelerated, the laundry 10 is generally gathered at the center of the drum 122. When the drum 122 is rotated at about 50 RPM, the laundry 10 may be gathered at the center of the drum and rolls over. As described above, wash water may be introduced from a water supply bellows 154 or a nozzle 165 and uniformly sprayed onto the laundry.

Afterwards, the drum 122 is accelerated again so that the laundry 10 gathered as shown in (a) of FIG. 14 rotates, while being uniformly distributed and clings to the inside of the drum 122. Each of the above steps may be repeated in short cycle. Cycle time in which acceleration and deceleration are repeated may be 1 to 4 seconds. Time to accelerate from 50 rpm to 100 rpm is 2 seconds or less, e.g., about 1.2 seconds. Time to decelerate from 100 rpm to 50 rpm is 1 second or less, e.g., about 0.5 seconds.

Figure 21:
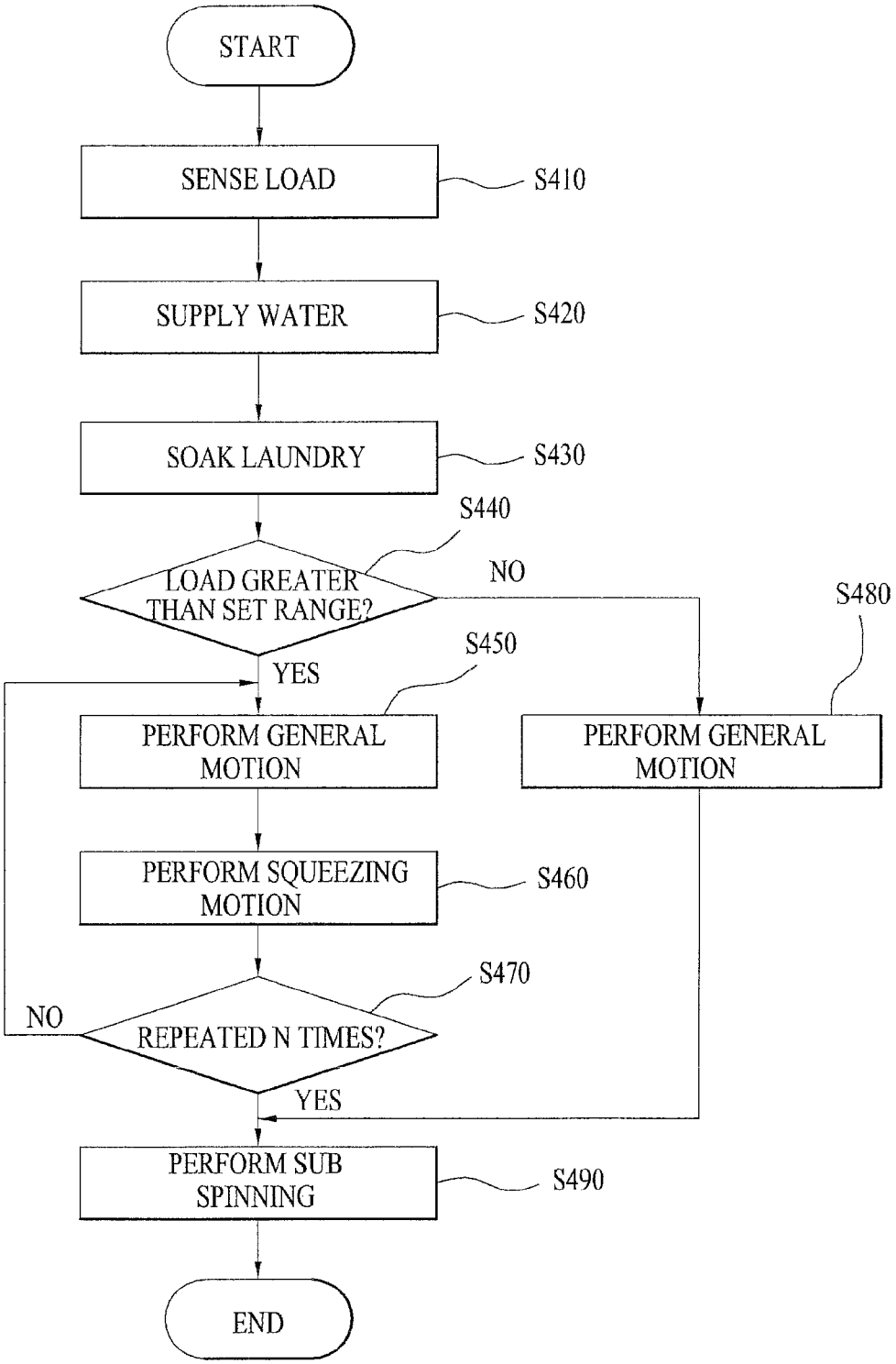
FIG. 21 is a flow chart showing a laundry treating method according to another embodiment of the present disclosure.

FIG. 21 is a flow chart showing a laundry treating method according to another embodiment of the present disclosure.

Load of laundry placed in the drum 122 is sensed (S410). When a user selects a washing course through the input unit 118 and depresses a washing start button, a wash cycle is started, and the load is sensed or determined. The washing course selected by the user may be a washing course in which a squeezing motion is performed. To wash a large amount of laundry, the user may select a specific washing course in which a squeezing motion is performed.

Load sensing or determination may be performed by various methods or devices. For example, the drive unit 130 rotates the drum 120 at a predetermined speed for a predetermined period of time, and then deceleration time is measured to sense the load. The longer the deceleration time of the drum 122, the higher the level of the load.

Water is supplied (S420). When the water supply valve 125 is opened, wash water is supplied into the tub 122 from an external water source. If the detergent is needed, the wash water may be mixed with a wash detergent or a fabric softener via the detergent box 133.

Upon completion of the water supplying or during the water supplying, laundry soaking is performed (S430). The laundry soaking is a process for moving laundry so that the laundry placed in the drum 122 is soaked in the wash water supplied into the tub 121. In general, the laundry soaking is performed by a tumbling motion, but may also be performed by the above-described squeezing motion. During the laundry soaking, the wash water may be pumped by the pump 160 and sprayed into the drum 122 by the first spray nozzle 170 and the second spray nozzle 180.

A determination is made as to whether or not the sensed load is more than a predetermined level to decide a drum motion in a washing cycle (S440). When the load exceeds the set range, a general motion is performed (S450), and a squeezing motion is performed (S460). The general motion refers to a rolling motion, a swing motion, and a step motion as well as a tumbling motion of FIG. 13.

If the general motion is repeated when the load is large, the laundry may become entangled, which may disable the movement of the laundry. Accordingly, the general motion is performed for a predetermined period of time, and then the squeezing motion is performed. Further, if the load is small, the laundry clings to the inside of the drum even at a low rpm, which may hinder the squeezing motion.

The squeezing motion changes the speed of the drum 122 in short cycle to move the laundry by repeatedly gathering and spreading the laundry. As the movement of the laundry is facilitated, washing deviation may be reduced and the laundry may be brought into uniform contact with the wash water. In addition, when the laundry clings to the inside of the drum 122, the wash water soaking through the laundry is discharged as if being squeezed out of the laundry. Therefore, contaminants may be discharged from the laundry during washing as if being squeezed out, and residual detergent may be discharged from the laundry as if being squeezed out. Moreover, as the laundry clings to and is separated from the inside of the drum 122 in a repeated manner, a user may visually check the movement of the laundry.

Execution time of the squeezing motion during the wash cycle may be about 10 minutes, but this may differ according to the load or washing course. In the squeezing motion, the wash water is pumped by the pump 160 and sprayed into the drum 122 by the first spray nozzle 170 and the second spray nozzle 180. The first spray nozzle 170 and the second spray nozzle 180 may spray the wash water upward to falling laundry.

A determination is made as to how many (N) times the general motion and the squeezing motion have been performed (S470). The general motion and the squeezing motion are performed N times so as to generate no washing deviation by virtue of the movement of the laundry. The repeated number of times N may be varied depending upon the selected course and the load.

When the general motion and the squeezing motion have been repeated N times, sub spinning is performed (S490). The sub spinning is a process for discharging the wash water used in washing to the outside.

From step S440, when the load is within the set range, the general motion is performed (S480), and the sub spinning is performed (S490).

The process up to the sub spinning step (S490) is a general washing process. The water supplying step (S420) is performed again to start a rinse cycle. The wash water supplied at this time is water not mixed with a wash detergent, but may be mixed with a fabric softener. Execution time of a squeezing motion during the rinse cycle may be about 3 minutes, but this may differ depending upon a load or a washing course.

The above steps shown in FIG. 15, steps corresponding to those of the wash cycle may be repeated even during the rinse cycle. However, the operation time of each step and the repeated number of times N may be changed.

Wash water may be uniformly sprayed into the drum. Wash water may be sprayed into the drum in a plurality of directions. Wash water may sprayed upward into the drum. Wash water may be sprayed to laundry such that the wash water applies strong impact to the laundry. Wash water, sprayed to laundry, penetrates the laundry, and may improve washing and rinsing performances. Wash water, sprayed to the laundry, bends and stretches the laundry, and may improve washing and rinsing performances. The spray nozzles may be provided at the lower part of the gasket such that the spray nozzles are adjacent to the pump, and may increase the amount of wash water sprayed by the spray nozzles. Non-uniform contact between wash water and laundry may be prevented during washing or rinsing, and may improve washing performance. The movement of laundry is facilitated, and may reduce washing deviation during washing or rinsing of a large amount of laundry.

A laundry treating apparatus includes a cabinet, a tub provided in the cabinet, a drum rotatably provided in the tub for receiving laundry, a gasket provided between the cabinet and the tub, a plurality of spray nozzles provided at a lower part of the gasket for spraying wash water upward into the drum, and a pump for pumping wash water to the spray nozzles.

A laundry treating apparatus may include a cabinet, a tub provided in the cabinet, a drum rotatably provided in the tub for receiving laundry, a gasket provided between the cabinet and the tub, and a plurality of spray nozzles provided at the gasket for spraying wash water into the drum in a plurality of directions.

A laundry treating method may include in a wash cycle or a rinse cycle, supplying wash water into a tub, rotating a drum provided in the tub for receiving laundry, and pumping the wash water in the tub when the drum is rotated and spraying the wash water into the drum from a front of the drum below the drum in a plurality of directions.

This application is related to U.S. application Ser. No. 12/902,300 filed Oct. 12, 2010 whose entire disclosure is incorporated herein by reference.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method for operating a laundry treatment apparatus, comprising:

supplying wash water into a tub during at least one of wash cycle or rinse cycle, the tub being provided in a cabinet;

rotating a drum having laundry;

pumping the wash water to a first spray nozzle and a second spray nozzle when the drum is rotated; and spraying the wash water into the drum in a plurality of directions by the first and second spray nozzles, wherein the first and second spray nozzles, provided at a gasket located between the cabinet and the tub, spray wash water into the drum, wherein the first and second spray nozzles are provided below an axis of rotation of the drum and separated from each other by a prescribed angle relative to the axis, at least one of the first spray nozzle or the second spray nozzles having a first surface and a plurality of guides on the first surface, the fluid being guided by at least one of the first nozzle or the second nozzle is sprayed into the drum, and wherein the guides comprise a plurality of grooves continuously arranged in the first surface and extending in a wash water flow direction.

2. The method according to claim 1, wherein at least one of the first spray nozzle or the second spray nozzle is integrally formed with gasket.

3. The method according to claim 1, wherein at least one of the first spray nozzle or the second spray nozzle protrude from the gasket.

4. The method according to claim 1, wherein at least one of the first spray nozzle or the second spray nozzles further has a second surface and a third surface to form a lower limit and a upper limit of the sprayed wash water, respectively.

5. The method according to claim 1, wherein a depth of the grooves is about ⅕ or less of a width between adjacent grooves.

6. The method according to claim 1, wherein each groove has an are profile.

7. The method according to claim 1, wherein the gasket is provided with a gasket channel for guiding wash water to at least one of the first spray nozzle or the second spray nozzles.

8. The method according to claim 7, wherein the gasket channel is connected to at least one spray channel by connectors.

9. The method according to claim 1, wherein the wash water is sprayed by the first and second spray nozzles toward a side of the drum.

10. The method according to claim 1, the first and second spray nozzles are provided at an inner circumference of a lower part of the gasket.

11. The method according to claim 1, wherein the step of rotating the drum comprises rotating the drum in a predetermined direction to drop the laundry in a repeated manner.

12. The method according to claim 1, wherein the wash water is sprayed by the first and second spray nozzles during the rotation of the drum such that the sprayed water impacts falling laundry.

13. The method according to claim 1, wherein the first spray nozzle and the second spray nozzle are symmetrically provided at the gasket.

14. The method of claim 1, wherein the first spray nozzle and the second spray nozzle spray the wash water simultaneously.

15. The method of claim 1, wherein the wash water is sprayed alternately between the first and second nozzles.

16. The method of claim 1, wherein a wash water spray formed by at least one of the first nozzle or the second nozzle has a plurality of main spray streams and water films formed between the main spray streams.

17. The method according to claim 16, wherein the number of the main spray streams sprayed to the upper region of the drum is greater than that of the main spray streams sprayed to the lower region of the drum.

18. The method according to claim 1, wherein the step of rotating the drum comprises accelerating and decelerating the drum.

19. The method according to claim 18, wherein when the drum is accelerated, the laundry in the drum rotates, clinging to the inside of the drum by centrifugal force, and when the drum is decelerated, the laundry is separated from the inside of the drum.

20. The method according to claim 18, wherein the wash water is sprayed upward into the drum by at least one of the first spray nozzle and the second spray nozzle during accelerating the drum.

21. The method according to claim 18, wherein the wash water is sprayed upward into the drum by at least one of the first spray nozzle and the second spray nozzle during decelerating the drum.

22. The method of claim 1, wherein the first surface corresponds to a prescribed surface of an opening provided for at least one of the first nozzle or the second nozzle facing a rear of drum.

23. The method of claim 22, wherein the opening is a single opening having a rectangular front profile.

* * * * *